US009803256B2

(12) United States Patent
Valdez et al.

(10) Patent No.: US 9,803,256 B2
(45) Date of Patent: Oct. 31, 2017

(54) HIGH PERFORMANCE MATERIAL FOR COILED TUBING APPLICATIONS AND THE METHOD OF PRODUCING THE SAME

(71) Applicant: Tenaris Coiled Tubes, LLC, Houston, TX (US)

(72) Inventors: Martin Valdez, Buenos Aires (AR); Gonzalo Gomez, Buenos Aires (AR); Jorge Mitre, Houston, TX (US); Bruce A. Reichert, Houston, TX (US)

(73) Assignee: TENARIS COILED TUBES, LLC, Houston, TX (US)

( * ) Notice: Subject to any disclaimer, the term of this patent is extended or adjusted under 35 U.S.C. 154(b) by 0 days.

(21) Appl. No.: 14/190,886

(22) Filed: Feb. 26, 2014

(65) Prior Publication Data

US 2014/0272448 A1 Sep. 18, 2014

Related U.S. Application Data

(60) Provisional application No. 61/783,701, filed on Mar. 14, 2013.

(51) Int. Cl.

| | |
|---|---|
| ***C21D 8/10*** | (2006.01) |
| ***C21D 9/08*** | (2006.01) |
| ***C21D 9/14*** | (2006.01) |
| ***C21D 9/50*** | (2006.01) |
| ***C21D 1/22*** | (2006.01) |
| *B21C 37/08* | (2006.01) |

(52) U.S. Cl.

CPC ..... *C21D 8/105* (2013.01); *C21D 1/22* (2013.01); *C21D 8/10* (2013.01); *C21D 9/08* (2013.01); *C21D 9/085* (2013.01); *C21D 9/14* (2013.01); *C21D 9/50* (2013.01); *C21D 9/505* (2013.01); *B21C 37/08* (2013.01); *C21D 2211/008* (2013.01); *Y10T 428/12333* (2015.01)

(58) Field of Classification Search

None

See application file for complete search history.

(56) References Cited

U.S. PATENT DOCUMENTS 3,316,395 A 4/1967 Lavin
3,316,396 A 4/1967 Trott et al.
(Continued)

FOREIGN PATENT DOCUMENTS

AR 0050159 A1 10/2006
AT 388791 B 8/1989
(Continued)

OTHER PUBLICATIONS

Savatori et. al. European Commision Report, Eur 2006, EUR2207, 3 pp. Stn_Abstract.*

(Continued)

*Primary Examiner* — Vera Katz

(74) *Attorney, Agent, or Firm* — Knobbe Martens Olson and Bear LLP

(57) ABSTRACT

Embodiments of the present disclosure are directed to coiled steel tubes and methods of manufacturing coiled steel tubes. In some embodiments, the final microstructures of the coiled steel tubes across all base metal regions, weld joints, and heat affected zones can be homogeneous. Further, the final microstructure of the coiled steel tube can be a mixture of tempered martensite and bainite.

15 Claims, 16 Drawing Sheets

(56) References Cited

U.S. PATENT DOCUMENTS 3,325,174 A 6/1967 Weaver
3,362,731 A 1/1968 Gasche et al.
3,366,392 A 1/1968 Kennel
3,413,166 A 11/1968 Zackay et al.
3,489,437 A 1/1970 Duret
3,512,789 A 5/1970 Tanner
3,552,781 A 1/1971 Helland
3,572,777 A 3/1971 Blose et al.
3,575,430 A 4/1971 Alpine
3,592,491 A 7/1971 Glover
3,599,931 A 8/1971 Hanson
3,655,465 A 4/1972 Snape et al.
3,733,093 A 5/1973 Seiler
3,810,793 A 5/1974 Heller
3,854,760 A 12/1974 Duret
3,889,989 A 6/1975 Legris et al.
3,891,224 A 6/1975 Ditcher
3,893,919 A 7/1975 Flegel et al.
3,915,697 A 10/1975 Giuliani et al.
3,918,726 A 11/1975 Kramer
3,986,731 A 10/1976 DeHoff
4,014,568 A 3/1977 Carter et al.
4,147,368 A 4/1979 Baker et al.
4,163,290 A 7/1979 Sutherlin et al.
4,219,204 A 8/1980 Pippert
4,231,555 A 11/1980 Saito
4,299,412 A 11/1981 Parmann
4,305,059 A 12/1981 Benton
4,310,163 A 1/1982 Pippert
4,336,081 A 6/1982 Hijikata et al.
4,345,739 A 8/1982 Wheatley
4,354,882 A 10/1982 Greer
4,366,971 A 1/1983 Lula
4,368,894 A 1/1983 Parmann
4,373,750 A 2/1983 Mantelle et al.
4,376,528 A 3/1983 Ohshimatani et al.
4,379,482 A 4/1983 Suzuki et al.
4,384,737 A 5/1983 Reusser
4,406,561 A 9/1983 Ewing
4,407,681 A 10/1983 Ina et al.
4,426,095 A 1/1984 Buttner
4,445,265 A 5/1984 Olson et al.
4,473,471 A 9/1984 Robichaud et al.
4,475,839 A 10/1984 Strandberg
4,491,725 A 1/1985 Pritchard
4,506,432 A 3/1985 Smith
4,526,628 A 7/1985 Ohno et al.
4,527,815 A 7/1985 Frick
4,564,392 A 1/1986 Ohhashi et al.
4,570,982 A 2/1986 Blose et al.
4,591,195 A 5/1986 Chelette et al.
4,592,558 A 6/1986 Hopkins
4,601,491 A 7/1986 Bell, Jr. et al.
4,602,807 A 7/1986 Bowers
4,623,173 A 11/1986 Handa et al.
4,629,218 A 12/1986 Dubois
4,662,659 A 5/1987 Blose et al.
4,674,756 A 6/1987 Fallon et al.
4,688,832 A 8/1987 Ortloff et al.
4,706,997 A 11/1987 Carstensen
4,710,245 A 12/1987 Roether
4,721,536 A 1/1988 Koch et al.
4,758,025 A 7/1988 Frick
4,762,344 A 8/1988 Perkins et al.
4,812,182 A 3/1989 Fang et al.
4,814,141 A 3/1989 Imai et al.
4,844,517 A 7/1989 Beiley et al.
4,856,828 A 8/1989 Kessler et al.
4,955,645 A 9/1990 Weems
4,958,862 A 9/1990 Cappelli et al.
4,988,127 A 1/1991 Cartensen
5,007,665 A 4/1991 Bovisio et al.
5,067,874 A 11/1991 Foote
5,137,310 A 8/1992 Noel et al.
5,143,381 A 9/1992 Temple
5,154,534 A 10/1992 Guerin et al.
5,180,008 A 1/1993 Aldridge et al.
5,191,911 A 3/1993 Dubois
5,242,199 A 9/1993 Hann et al.
5,328,158 A 7/1994 Lewis et al.
5,348,350 A 9/1994 Blose et al.
5,352,406 A 10/1994 Barteri et al.
5,360,239 A 11/1994 Klementich
5,449,420 A 9/1995 Okada et al.
5,454,883 A 10/1995 Yoshie et al.
5,456,405 A * 10/1995 Stagg ..... B21C 37/0826 228/125
5,505,502 A 4/1996 Smith et al.
5,515,707 A 5/1996 Smith
5,538,566 A 7/1996 Gallagher
5,592,988 A 1/1997 Meroni et al.
5,598,735 A 2/1997 Saito et al.
5,653,452 A 8/1997 Järvenkylä
5,712,706 A 1/1998 Castore et al.
5,794,985 A 8/1998 Mallis
5,810,401 A 9/1998 Mosing et al.
5,860,680 A 1/1999 Drijver et al.
5,879,030 A 3/1999 Clayson et al.
5,879,474 A 3/1999 Bhadeshia et al.
5,944,921 A 8/1999 Cumino et al.
5,993,570 A 11/1999 Gray
6,006,789 A 12/1999 Toyooka et al.
6,030,470 A 2/2000 Hensger et al.
6,044,539 A 4/2000 Guzowski
6,045,165 A 4/2000 Sugino et al.
6,056,324 A 5/2000 Reimert et al.
6,070,912 A 6/2000 Latham
6,173,968 B1 1/2001 Nelson et al.
6,188,037 B1 2/2001 Hamada et al.
6,196,530 B1 3/2001 Muhr et al.
6,217,676 B1 4/2001 Takabe et al.
6,248,187 B1 6/2001 Asahi et al.
6,267,828 B1 7/2001 Kushida et al.
6,311,965 B1 11/2001 Muhr et al.
6,331,216 B1 12/2001 Toyooka et al.
6,347,814 B1 2/2002 Cerruti
6,349,979 B1 2/2002 Noel et al.
6,358,336 B1 3/2002 Miyata
6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.
6,494,499 B1 12/2002 Galle, Sr. et al.
6,514,359 B2 2/2003 Kawano
6,527,056 B2 3/2003 Newman
6,540,848 B2 4/2003 Miyata et al.
6,550,822 B2 4/2003 Mannella et al.
6,557,906 B1 5/2003 Carcagno
6,558,484 B1 5/2003 Onoe et al.
6,581,940 B2 6/2003 Dittel
6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Morotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura

(56) References Cited

U.S. PATENT DOCUMENTS

| | | | | |
|---|---|---|---|---|
| 7,083,686 | B2 | 8/2006 | Itou | |
| 7,108,063 | B2 | 9/2006 | Carstensen | |
| 7,118,637 | B2 | 10/2006 | Kusinski et al. | |
| 7,182,140 | B2 | 2/2007 | Wood | |
| 7,214,278 | B2 | 5/2007 | Kusinski et al. | |
| 7,255,374 | B2 | 8/2007 | Carcagno et al. | |
| 7,264,684 | B2 | 9/2007 | Numata et al. | |
| 7,284,770 | B2 | 10/2007 | Dell'erba et al. | |
| 7,310,867 | B2 | 12/2007 | Corbett, Jr. | |
| 7,431,347 | B2 | 10/2008 | Ernst et al. | |
| 7,464,449 | B2 | 12/2008 | Santi et al. | |
| 7,475,476 | B2 | 1/2009 | Roussie | |
| 7,478,842 | B2 | 1/2009 | Reynolds, Jr. et al. | |
| 7,506,900 | B2 | 3/2009 | Carcagno et al. | |
| 7,621,034 | B2 | 11/2009 | Roussie | |
| 7,635,406 | B2 | 12/2009 | Numata et al. | |
| 7,735,879 | B2 | 6/2010 | Toscano et al. | |
| 7,744,708 | B2 | 6/2010 | López et al. | |
| 7,753,416 | B2 | 7/2010 | Mazzaferro et al. | |
| 7,862,667 | B2 | 1/2011 | Turconi et al. | |
| 8,002,910 | B2 | 8/2011 | Tivelli et al. | |
| 8,007,601 | B2 | 8/2011 | López et al. | |
| 8,007,603 | B2 | 8/2011 | Garcia et al. | |
| 8,016,362 | B2 | 9/2011 | Itoga | |
| 8,262,094 | B2 | 9/2012 | Beele | |
| 8,262,140 | B2 | 9/2012 | Santi et al. | |
| 8,317,946 | B2 | 11/2012 | Arai et al. | |
| 8,328,958 | B2 | 12/2012 | Turconi et al. | |
| 8,328,960 | B2 | 12/2012 | Gomez et al. | |
| 8,333,409 | B2 | 12/2012 | Santi et al. | |
| 8,414,715 | B2 | 4/2013 | Altschuler et al. | |
| 8,544,304 | B2 | 10/2013 | Santi | |
| 8,636,856 | B2 | 1/2014 | Altschuler et al. | |
| 8,821,653 | B2 | 9/2014 | Anelli et al. | |
| 8,840,152 | B2 | 9/2014 | Carcagno et al. | |
| 8,926,771 | B2 | 1/2015 | Agazzi | |
| 9,004,544 | B2 | 4/2015 | Carcagno et al. | |
| 9,163,296 | B2 * | 10/2015 | Valdez | C21D 8/105 |
| 9,187,811 | B2 | 11/2015 | Gomez et al. | |
| 9,222,156 | B2 | 12/2015 | Altschuler et al. | |
| 9,234,612 | B2 | 1/2016 | Santi et al. | |
| 9,340,847 | B2 | 5/2016 | Altschuler et al. | |
| 9,383,045 | B2 | 7/2016 | Santi et al. | |
| 9,598,746 | B2 | 3/2017 | Anellie et al. | |
| 2001/0035235 | A1 | 11/2001 | Kawano | |
| 2002/0011284 | A1 | 1/2002 | Von Hagen et al. | |
| 2002/0153671 | A1 | 10/2002 | Raymond et al. | |
| 2002/0158469 | A1 | 10/2002 | Mannella et al. | |
| 2003/0019549 | A1 | 1/2003 | Turconi et al. | |
| 2003/0111146 | A1 | 6/2003 | Kusinski et al. | |
| 2003/0116238 | A1 | 6/2003 | Fujita | |
| 2003/0155052 | A1 | 8/2003 | Kondo et al. | |
| 2003/0165098 | A1 | 9/2003 | Ohara et al. | |
| 2003/0168859 | A1 | 9/2003 | Watts | |
| 2004/0118490 | A1 | 6/2004 | Klueh et al. | |
| 2004/0118569 | A1 | 6/2004 | Brill et al. | |
| 2004/0131876 | A1 | 7/2004 | Ohgami et al. | |
| 2004/0139780 | A1 | 7/2004 | Cai et al. | |
| 2004/0187971 | A1 | 9/2004 | Omura | |
| 2004/0195835 | A1 | 10/2004 | Noel et al. | |
| 2004/0262919 | A1 | 12/2004 | Dutilleul et al. | |
| 2005/0012278 | A1 | 1/2005 | Delange | |
| 2005/0076975 | A1 | 4/2005 | Lopez | |
| 2005/0087269 | A1 | 4/2005 | Merwin | |
| 2005/0093250 | A1 | 5/2005 | Santi et al. | |
| 2005/0166986 | A1 | 8/2005 | Dell'erba et al. | |
| 2006/0006600 | A1 | 1/2006 | Roussie | |
| 2006/0124211 | A1 | 6/2006 | Takano et al. | |
| 2006/0137781 | A1 | 6/2006 | Kusinski et al. | |
| 2006/0157539 | A1 | 7/2006 | Dubois | |
| 2006/0169368 | A1 | 8/2006 | Lopez et al. | |
| 2006/0231168 | A1 | 10/2006 | Nakamura et al. | |
| 2006/0243355 | A1 | 11/2006 | Haiderer et al. | |
| 2006/0273586 | A1 | 12/2006 | Reynolds, Jr. et al. | |
| 2007/0039149 | A1 | 2/2007 | Roussie | |
| 2007/0089813 | A1 | 4/2007 | Tivelli | |
| 2007/0137736 | A1 | 6/2007 | Omura et al. | |
| 2007/0216126 | A1 | 9/2007 | Lopez et al. | |
| 2007/0246219 | A1 | 10/2007 | Manella et al. | |
| 2008/0047635 | A1 | 2/2008 | Kondo et al. | |
| 2008/0115863 | A1 | 5/2008 | McCrink et al. | |
| 2008/0129044 | A1 | 6/2008 | Carcagno et al. | |
| 2008/0219878 | A1 | 9/2008 | Kondo et al. | |
| 2008/0226396 | A1 | 9/2008 | Garcia et al. | |
| 2008/0226491 | A1 | 9/2008 | Satou et al. | |
| 2008/0257459 | A1 | 10/2008 | Arai et al. | |
| 2008/0264129 | A1 | 10/2008 | Cheppe et al. | |
| 2008/0303274 | A1 | 12/2008 | Mazzaferro et al. | |
| 2008/0314481 | A1 | 12/2008 | Garcia et al. | |
| 2009/0010794 | A1 | 1/2009 | Turconi et al. | |
| 2009/0033087 | A1 | 2/2009 | Carcagno et al. | |
| 2009/0047166 | A1 | 2/2009 | Tomomatsu et al. | |
| 2009/0101242 | A1 | 4/2009 | Lopez et al. | |
| 2009/0114318 | A1 | 5/2009 | Arai et al. | |
| 2009/0226988 | A1 | 9/2009 | Satou et al. | |
| 2010/0136363 | A1 | 6/2010 | Valdez et al. | |
| 2010/0187808 | A1 | 7/2010 | Santi | |
| 2010/0193085 | A1 | 8/2010 | Garcia | |
| 2010/0206553 | A1 | 8/2010 | Bailey et al. | |
| 2010/0294401 | A1 | 11/2010 | Gomez | |
| 2010/0319814 | A1 | 12/2010 | Perez | |
| 2010/0327550 | A1 | 12/2010 | Lopez | |
| 2011/0042946 | A1 | 2/2011 | Santi | |
| 2011/0077089 | A1 | 3/2011 | Hirai et al. | |
| 2011/0097235 | A1 | 4/2011 | Turconi et al. | |
| 2011/0133449 | A1 | 6/2011 | Mazzaferro | |
| 2011/0233925 | A1 | 9/2011 | Pina | |
| 2011/0247733 | A1 | 10/2011 | Arai et al. | |
| 2011/0259482 | A1 | 10/2011 | Peters et al. | |
| 2011/0284137 | A1 * | 11/2011 | Kami et al. | 148/504 |
| 2012/0018056 | A1 | 1/2012 | Nakagawa et al. | |
| 2012/0186686 | A1 | 7/2012 | Valdez | |
| 2012/0199255 | A1 | 8/2012 | Anelli | |
| 2012/0267014 | A1 | 10/2012 | Hitoshio et al. | |
| 2013/0000790 | A1 | 1/2013 | Arai et al. | |
| 2013/0004787 | A1 | 1/2013 | Ishiyama et al. | |
| 2013/0199674 | A1 * | 8/2013 | Altschuler et al. | 148/328 |
| 2013/0264123 | A1 * | 10/2013 | Altschuler et al. | 175/325.2 |
| 2014/0021244 | A1 | 1/2014 | DuBois | |
| 2014/0027497 | A1 | 1/2014 | Rowland et al. | |
| 2014/0057121 | A1 * | 2/2014 | Altschuler et al. | 428/544 |
| 2014/0137992 | A1 | 5/2014 | Ishiguro et al. | |
| 2014/0251512 | A1 | 9/2014 | Gomez | |
| 2014/0299235 | A1 | 10/2014 | Anelli | |
| 2014/0299236 | A1 | 10/2014 | Anelli | |
| 2015/0368986 | A1 | 12/2015 | Narikawa et al. | |
| 2016/0024625 | A1 | 1/2016 | Valdez | |
| 2016/0102856 | A1 | 4/2016 | Minami | |
| 2016/0305192 | A1 | 10/2016 | Buhler | |

FOREIGN PATENT DOCUMENTS

| | | |
|---|---|---|
| CA | 2319926 | 7/2008 |
| CN | 1401809 | 3/2003 |
| CN | 1487112 | 4/2004 |
| CN | 1292429 | 12/2006 |
| CN | 101480671 | 7/2009 |
| CN | 101542002 | 9/2009 |
| CN | 101613829 A | 12/2009 |
| CN | 101413089 | 11/2010 |
| DE | 3310226 A1 | 10/1984 |
| DE | 4446806 | 5/1996 |
| EA | 010037 | 6/2008 |
| EA | 012256 | 8/2009 |
| EP | 0 032 265 | 7/1981 |
| EP | 0 092 815 | 11/1983 |
| EP | 0 104 720 | 4/1984 |
| EP | 0 159 385 | 10/1985 |
| EP | 0 309 179 | 3/1989 |
| EP | 0 340 385 | 11/1989 |
| EP | 0 329 990 | 11/1992 |
| EP | 0 658 632 | 6/1995 |
| EP | 0 753 595 | 1/1997 |
| EP | 0788850 | 8/1997 |

(56) References Cited

FOREIGN PATENT DOCUMENTS

| | | | |
|---|---|---|---|
| EP | 0 828 007 | A | 3/1998 |
| EP | 0 989 196 | | 3/2000 |
| EP | 1 008 660 | | 6/2000 |
| EP | 0 1 027 944 | | 8/2000 |
| EP | 1 065 423 | | 1/2001 |
| EP | 828 007 | | 11/2001 |
| EP | 1 269 059 | | 1/2003 |
| EP | 1 277 848 | | 1/2003 |
| EP | 1 288 316 | | 3/2003 |
| EP | 1 296 088 | | 3/2003 |
| EP | 1 362977 | | 11/2003 |
| EP | 1 413 639 | | 4/2004 |
| EP | 1 182 268 | | 9/2004 |
| EP | 1 705 415 | | 9/2006 |
| EP | 1 717 324 | | 11/2006 |
| EP | 1 726 861 | | 11/2006 |
| EP | 1 876 254 | | 1/2008 |
| EP | 1 914 324 | | 4/2008 |
| EP | 2 000 629 | | 12/2008 |
| EP | 1 554 518 | | 1/2009 |
| EP | 2 028 284 | | 2/2009 |
| EP | 2 133 442 | | 12/2009 |
| EP | 2 216 576 | | 8/2010 |
| EP | 2 239 343 | | 10/2010 |
| FR | 1 149 513 | A | 12/1957 |
| FR | 1489013 | | 7/1967 |
| FR | 2 704 042 | A | 10/1994 |
| FR | 2 848 282 | A1 | 6/2004 |
| FR | 2855587 | | 12/2004 |
| GB | 498 472 | | 1/1939 |
| GB | 1 398 214 | | 6/1973 |
| GB | 1 428 433 | | 3/1976 |
| GB | 2 104 919 | A | 3/1983 |
| GB | 2 234 308 | A | 1/1991 |
| GB | 2 276 647 | | 10/1994 |
| GB | 2 388 169 | A | 11/2003 |
| JP | 58-187684 | | 12/1983 |
| JP | 60-086209 | | 5/1985 |
| JP | S60 116796 | A | 6/1985 |
| JP | 60-215719 | A | 10/1985 |
| JP | 36025719 | | 10/1985 |
| JP | S61-103061 | | 5/1986 |
| JP | 61 270355 | | 11/1986 |
| JP | 63 004046 | A2 | 1/1988 |
| JP | 63 004047 | A2 | 1/1988 |
| JP | 63-230847 | A2 | 9/1988 |
| JP | 63230851 | A2 | 9/1988 |
| JP | 01-242761 | A | 9/1989 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | H06-042645 | | 2/1994 |
| JP | 06-093339 | | 4/1994 |
| JP | 06 172859 | A2 | 6/1994 |
| JP | 06-220536 | | 8/1994 |
| JP | 07-003330 | | 1/1995 |
| JP | 07 041856 | A2 | 2/1995 |
| JP | 07-139666 | | 5/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 2704042 | | 10/1997 |
| JP | 10 140250 | | 5/1998 |
| JP | 10 176239 | | 6/1998 |
| JP | 10 280037 | A | 10/1998 |
| JP | 11 050148 | A | 2/1999 |
| JP | 11 140580 | | 5/1999 |
| JP | 11 229079 | | 8/1999 |
| JP | 2000-063940 | | 2/2000 |
| JP | 2000-178645 | | 6/2000 |
| JP | 2000-248337 | A | 9/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2002-130554 | | 5/2002 |
| JP | 2004-011009 | | 1/2004 |
| JP | 2007-031769 | | 7/2005 |
| JP | 60 174822 | | 9/2005 |
| KR | 0245031 | | 3/2000 |
| UA | 51138 | A | 11/2002 |
| WO | WO 84/02947 | | 8/1984 |
| WO | WO 94/29627 | | 12/1994 |
| WO | WO 96/22396 | | 7/1996 |
| WO | WO 00/06931 | | 2/2000 |
| WO | WO 00/70107 | | 11/2000 |
| WO | WO 01/75345 | | 10/2001 |
| WO | WO 01/88210 | | 11/2001 |
| WO | WO 02/29290 | | 4/2002 |
| WO | WO 02/35128 | | 5/2002 |
| WO | WO 02/068854 | | 9/2002 |
| WO | WO 02/086369 | | 10/2002 |
| WO | WO 02/093045 | | 11/2002 |
| WO | WO 03/033856 | | 4/2003 |
| WO | WO 03/048623 | | 6/2003 |
| WO | WO 03/087646 | | 10/2003 |
| WO | WO 2004/023020 | | 3/2004 |
| WO | WO 2004/031420 | | 4/2004 |
| WO | WO 2004/033951 | | 4/2004 |
| WO | WO 2004/053376 | | 6/2004 |
| WO | WO 2004/097059 | | 11/2004 |
| WO | WO 2004/109173 | | 12/2004 |
| WO | WO 2006/003775 | | 6/2005 |
| WO | WO 2006/009142 | | 1/2006 |
| WO | WO 2006/087361 | | 4/2006 |
| WO | WO 2006/078768 | | 7/2006 |
| WO | WO 2007/002576 | | 1/2007 |
| WO | WO 2007/017082 | | 2/2007 |
| WO | WO 2007/017161 | | 2/2007 |
| WO | WO 2007/023806 | | 3/2007 |
| WO | WO 2007/028443 | | 3/2007 |
| WO | WO 2007/034063 | | 3/2007 |
| WO | WO 2007/063079 | | 6/2007 |
| WO | WO 2008/003000 | | 1/2008 |
| WO | WO 2008/007737 | | 1/2008 |
| WO | WO 2008/090411 | | 7/2008 |
| WO | WO 2008/110494 | | 9/2008 |
| WO | WO 2008/127084 | | 10/2008 |
| WO | WO 2009/000851 | | 12/2008 |
| WO | WO 2009/000766 | | 1/2009 |
| WO | WO 2009/010507 | | 1/2009 |
| WO | WO 2009/027308 | | 3/2009 |
| WO | WO 2009/027309 | | 3/2009 |
| WO | WO 2009/044297 | | 4/2009 |
| WO | WO 2009/065432 | | 5/2009 |
| WO | WO 2009/106623 | | 9/2009 |
| WO | WO 2010/061882 | | 6/2010 |
| WO | WO 2010/122431 | | 10/2010 |
| WO | WO 2011/152240 | | 12/2011 |
| WO | WO 2013/007729 | | 1/2013 |

OTHER PUBLICATIONS

European Search Report and Opinion, re EPO Application No. EP 14159174.3, dated Jul. 3, 2014.

Chitwood, G. B., et al.: "High-Strength Coiled Tubing Expands Service Capabilities", as presented at the 24th Annual OTC in Houston, Texas, May 4-7, 1992, in 15 pages.

European Extended Search Report re EPO Application No. 12152516.6, dated Jun. 25, 2012.

Hollomon, J.H., et al., Time-tempered Relations in Tempering Steel. New York Meeting, pp. 223-249, 1945.

(56) References Cited

OTHER PUBLICATIONS

International Standard Publication. Petroleum and natural gas industries—Materials for use in H2Scontaining environments in oil and gas production. ANSI/NACE ISO, 145 pages, 2009.
Pollack, Herman, W., Materials Science and Metallurgy, Fourth Edition, pp. 96 and 97, 1988.
Tenaris brochure. Coiled Tubes HS80CRA, 2 pages, 2008.
Tenaris brochure. Coiled Tubes Suggested Field Welding Procedure (GTAW) for Coiled Tubing Grads HS70, HS80, HS90, HS11 0, 3 pages, 2007.
Tenaris brochure. Coiled Tubing for Downhole Applications, 10 pages, 2007.
"Seamless Steel Tubes for Pressure Purposes—Technical Delivery Conditions—Part 1: Non-alloy Steel Tubes with Specified Room Temperature Properties" British Standard BS EN 10216-1:2002 E:1-26, published May 2002.
"Seamless Steel Tubes for Pressure Purposes—Technical Delivery Conditions—Part 2: Non-alloy and Alloy Steel Tubes with Specified Elevated Temperature Properties" British Standard BS EN 10216-2:2002+A2:2007:E:1-45, published Aug. 2007.
"Seamless Steel Tubes for Pressure Purposes—Technical Delivery Conditions—Part 3: Alloy Fine Grain Steel Tubes" British Standard BS EN 10216-3:2002 +A1:2004 E:1-34, published Mar. 2004.
"Seamless Steel Tubes for Pressure Purposes—Technical Delivery Conditions—Part 4: Non-alloy and Alloy Steel Tubes with Specified Low Temperature Properties" British Standard BS EN 10216-4:2002 + A1:2004 E:1-30, published Mar. 2004.
Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.
Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.
Asahi, et al., Development of Ultra-high-strength Linepipe, X120, Nippon Steel Technical Report, Jul. 2004, Issue 90, pp. 82-87.
ASM Handbook, Mechanical Tubing and Cold Finishing, Metals Handbook Desk Edition, (2000), 5 pages.
Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A., "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Boulegue, Jacques, "Equilibria in a sulfide rich water from Enghien-les-Bains, France", Geochimica et Cosmochimica Acta, Pergamon Press, 1977, vol. 41, pp. 1751-1758, Great Britain.
Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.
Cancio et al., "Characterization of microalloy precipitates in the austenitic range of high strength low alloy steels", Steel Research, 2002, vol. 73, pp. 340-346.
Carboni, A., A. Pigani, G. Megahed, S. Paul, "Casting and rolling of API X 70 grades for artic application in a thin slab rolling plant", Stahl u Eisen, 2008, N° 1, p. 131-134.
Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.
Clark, A. Horrell, "Some Comments on the Composition and Stability Relations of Mackinawite", Neues Jahrbuch fur Mineralogie, 1966, vol. 5, pp. 300-304, London, England.
Craig, Bruce D., "Effect of Copper on the Protectiveness of Iron Sulfide Films", Corrosion, National Association of Corrosion Engineers, 1984, vol. 40, Issue 9, pp. 471-474.
D.O.T. 178.68 Spec. 39, pp. 831-840, Non reusable (non refillable) cylinders, Oct. 1, 2002.
De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.
Drill Rod Joint Depth Capacity Chart, downloaded Jan. 15, 2013; http://www.boartlongyear.com/drill-rod-joint-depth-capacity-chart.
Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.
Fang, Hong-Sheng, et al.: "The Developing Prospect of Air-cooled Bainitic Steels", International Journal of Issi, vol. 2, No. 2, Feb. 1, 2005, pp. 9-18.
Fratini et al.: "Improving friction stir welding of blanks of different thicknesses," Materials Science and Engineering A 459 (2007).
Gojic, Mirko and Kosec, Ladislav, "The Susceptibility to the Hydrogen Embrittlement of Low Alloy Cr and CrMo Steels", ISIJ International, 1997, vol. 37, Issue 4, pp. 412-418.
Heckmann, et al., Development of low carbon Nb-Ti-B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", IIR, London, Apr. 1997, 11 pages.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.
Keizer, Joel, "Statistical Thermodynamics of Nonequilibrium Processes", Springer-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mehling, Wilfred L.: "Hot Upset Forging," ASM Handbook vol. 14, 1998, pp. 84-95.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Möessbauer Studies of Iron Sulfides", J. Inorg. Nucl. Chem., 1969, vol. 31, pp. 3797-3802.

(56) References Cited

OTHER PUBLICATIONS

Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochimica et Cosmochimica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
Nagata, M., J. Speer, D. Matlock, "Titanium nitride precipitation behavior in thin slab cast high strength low alloyed steels", Metallurgical and Materials Transactions A, 2002 ,vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Nandan et al.: "Recent advances in friction-stir welding—Process, weldment structure and properties," Progress in Materials Science 53 (2008) 980-1023.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Temperatures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde . . . , 1984, vol. 75, pp. 76-81.
Savatori et al.: European Commission Report, EUR 2006, EUR2207, 3 pp. STN_Abstract.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.
Smyth, D., et al.: Steel Tubular Products, Properties and Selection: Irons, Steels, and High-Performance Alloys, vol. 1, ASM Handbook, ASM International, 1990, p. 327-336.
Spry, Alan, "Metamorphic Textures", Perganon Press, 1969, New York.
Taira et al., "HIC and SSC Resistance of Line Pipes for Sour Gas Service, Nippon Kokan Technical Report", 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall—High Strength Seamless Pipes for Deep Water Applications", RioPipeline 2005, Oct. 17 to 19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe—Cr—Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstructure and precipitation control"; "Paper 01077", NACE International, Houston, TX, Mar. 16, 2001. (XP009141583).
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
Yu, et al.: "New steels and alloys in mechanical engineering / ed.," M: Mechanical Engineering, 1976, p. 19.
ASTM A 213/A 213M "Standard Specification for Seamless Ferritic and Austenitic Alloy-Steel Boiler, Superheater, and Heat-Exchanger Tubes".
ASTM A182/A182M "Standard Specification for Forged or Rolled Alloy and Stainless Steel Pipe Flanges, Forged Fittings, and Valves and Parts for High-Temperature Service".
ASTM A336/A336M "Standard Specification for Alloy Steel Forgings for Pressure and High-Temperature Parts".
ASTM A355 which is related to "Seamless Ferritic Alloy-Steel Pipe for High-Temperature Service".
ASTM, "E112-13 Standard Test Methods for Determining Average Grain Size," ASTM International. 2012. p. 1-28.
Davis, J.R., et al. "ASM—Speciality Handbook—Carbon and alloy steels" ASM Speciality Handbook, Carbon and Alloy Steels, 1996, pp. 12-27, XP002364757 US.
E. Anelli, et al., "Metallurgical Design of Advanced Heavy Wall Seamless pipes for Deepwater Applications", 4th International Conference on Pipeline Technology, May 9-13, 2004, Ostend, Belgium.
Echaniz, "The effect of microstructure on the KISSC of low alloy carbon steels", NACE Corrosion '98, EE. UU., Mar. 1998, pp. 22-27, San Diego.
Extrait du Catalogue N 940, 1994.
Fritz T et al, "Characterization of electroplated nickel", Microsystem Technologies, Dec. 31, 2002, vol. 9, No. 1-2, pp. 87-91, Berlin, DE.
Gomez, G., et al.: "Air cooled bainitic steels for strong, seamless pipes—Part 1—allowy design, kinetics and microstructure", Materials Science and Technology, vol. 25, No. 12, Dec. 1, 2009. (XP002611498).
Hutchings et al., "Ratio of Specimen thickness to charging area for reliable hydrogen permeation measurement", British Corrosion. Journal, 1993, vol. 28, Issue 4, pp. 309-312.
Jacobs, Lucinda and Emerson, Steven, "Trace Metal Solubility in an Anoxid Fjord", Earth and Planetary Sci. Letters, Elsevier Scientific Publishing Company, 1982, vol. 60, pp. 237-252, Amsterdam, Netherlands.
Kazutoshi Ohashi et al, "Evaluation of r-value of steels using Vickers hardness test", Journal of Physics: Conference Series, Aug. 7, 2012, p. 12045, vol. 379, No. 1, Institute of Physics Publishing, Bristol, GB.
Tivelli et al., "Metakkurgical Aspects of Heavy Wall—High Strength Seamless Pipes for Deep Water Applications", RioPipeline, Oct. 17-19, 2005, Rio, Brasil.
Mechanical Tubing and Cold Finishing, Metals Handbook Desk Edition, (2000), 5 pages.
NACE MR0175/ISO 15156-1 Petroleum and natural gas industries—Materials for use in H2S-containing Environments in oil and gas production—Part 1: General principles for selection of cracking-resistant materials, Jun. 28, 2007.
Specification for Threading, Gauging and Thread Inspection of Casing, Tubing, and Line Pipe Threads, American Petroleum Institute, Specification 5B, Apr. 2008, 15th Edition (Excerpts Only).

* cited by examiner

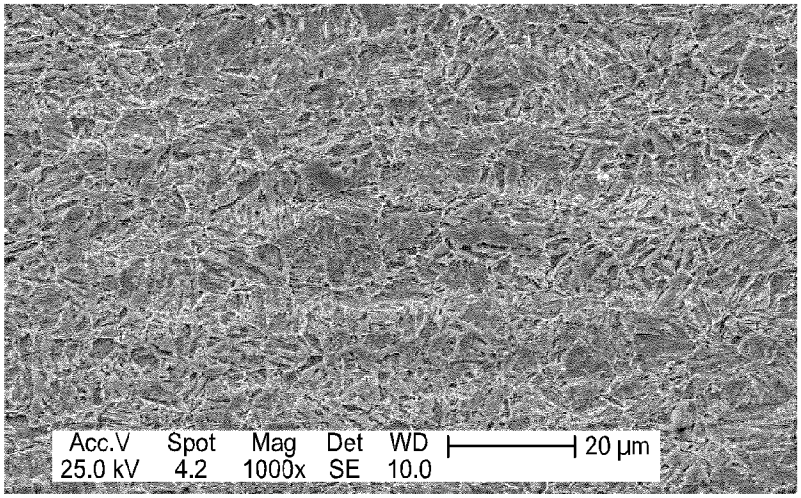
FIG. IIB
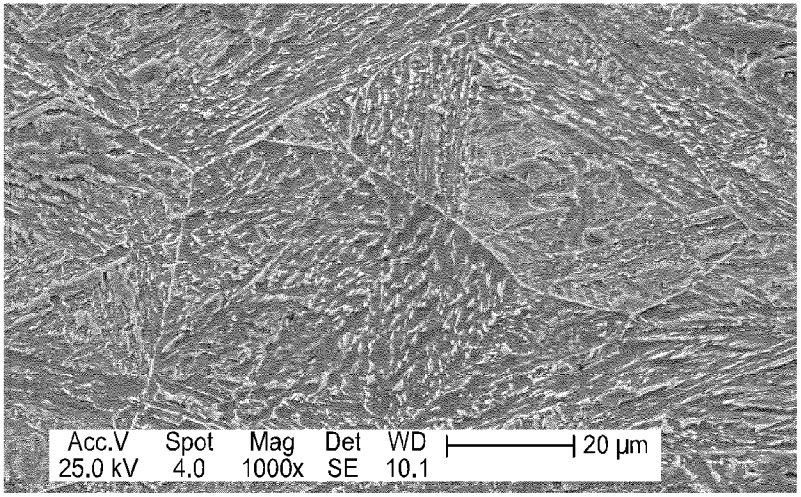
FIG. IIA

HIGH PERFORMANCE MATERIAL FOR COILED TUBING APPLICATIONS AND THE METHOD OF PRODUCING THE SAME

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

RELATED APPLICATION

This application is related to Applicant's co-pending application entitled COILED TUBE WITH VARYING MECHANICAL PROPERTIES FOR SUPERIOR PERFORMANCE AND METHODS TO PRODUCE THE SAME BY A CONTINUOUS HEAT TREATMENT, Ser. No. 13/229,517, filed Sep. 9, 2011 and published as US 2012/0186686 A1 on Jul. 26, 2012, the entirety of which is hereby incorporated by reference.

BACKGROUND

Description of the Related Art

In recent years the use of coiled tubing has been expanded to applications that require high pressure and extended reach operations. As a consequence, there is a need to produce coiled tubing with elevated tensile properties in order to withstand: i) axial loads on hanging or pooling long strings, and ii) elevated pressures applied during operation.

The standard production of coiled tubing uses as raw material, hot rolled strips with mechanical properties achieved through microstructural refinement during rolling. This refinement is obtained with the use of different microalloying additions (Ti, N, V) as well as appropriate selection of hot rolling processing conditions. The objective is to control material recrystallization and grain growth in order to achieve an ultra-fine microstructure. The material is limited in the use of solid solution alloying elements and precipitation hardening, since refinement is the only mechanism that allows for high strength and toughness, simultaneously.

This raw material is specified to each supplier, and may require varying mechanical properties in the hot rolled steel in order to produce coiled tubes with varying mechanical properties as well. As the properties increase, the cost of production and hence the raw material cost also increases. It is known that the strip-to-strip welding process used during the assembly of the "long strip" that will be ERW formed/welded into the coiled tubing, deteriorates the joining area. Thereafter, the coiled tubing with increasing properties, tend to have a relatively lower performance on the area of the strip welds. This deterioration is caused by the fact that the welding processes destroys the refinement introduced during hot rolling, and there is no simple post weld heat treatment capable of regenerating both tensile and toughness properties. In general tensile is restored but toughness and its associated fatigue life are deteriorated in this zone. Current industrial route can produce high strength coiled tubing, only at elevated cost and with poor relative performance of strip welds joins with respect to pipe body.

One alternative for producing a coiled tubing is through a full body heat treatment. This treatment is applied to a material that has been formed into a pipe in the so called "green" state, because its properties are yet to be defined by the heat treatment conditions. In this case the main variables affecting the final product properties are the steel chemistry and the heat treatments conditions. Thereafter, by appropriately combining steel composition with welding material and heat treatment, the coiled tubing could be produced with uniform properties across the length eliminating the weak link of the strip-to-strip join that is critical on high strength conventional coiled tubing. This general concept has been described before but never applied successfully to the production of high strength coiled tubing (yield strength in the range from 80 to 140 ksi). The reason being that the heat treatment at elevated line speed (needed to achieve high productivity) will generally result in the need for complicated and extended facilities. This process could be simplified if the appropriated chemistry and heat treatment conditions are selected.

The selection of the chemistry that is compatible with an industrial heat treatment facility of reasonable dimensions requires of an understanding of the many variables that affect coiled tubing performance measured as: a) Axial Mechanical Properties, b) Uniformity of Microstructure and Properties, c) Toughness, d) Fatigue Resistance, e) Sour Resistance, among others.

SUMMARY

Below is described chemistry designed to produce a heat treated coiled tubing which is mostly outside current limits for coiled tubing as set by API 5ST standard. (Max.C:0.16%, Max.Mn:1.2% (CT70-90) Max.Mn:1.65 (CT100-110), Max.P:0.02% (CT70-90) Max.P:0.025 (CT100-CT110), Max.S:0.005, Si.Max:0.5).

Embodiments of this disclosure are for a coiled steel tube and methods of producing the same. The tube in some embodiments can comprise a yield strength higher than about 80 Ksi. The composition of the tube can comprise 0.16-0.35 wt. % carbon, 0.30-2.00 wt. % manganese, 0.10-0.35 wt. % silicon, up to 0.005 wt. % sulfur, up to 0.018 wt. % phosphorus, the remainder being iron and inevitable impurities. The tube can also comprise a final microstructure comprising a mixture of tempered martensite and bainite, wherein the final microstructure of the coiled tube comprises more than 90 volume % tempered martensite, wherein the microstructure is homogenous in pipe body, ERW line and strip end-to-end joints.

Disclosed herein is a coiled steel tube formed from a plurality of welded strips, wherein the tube can include base metal regions, weld joints, and their heat affected zones, and can comprise a yield strength greater than about 80 ksi, a composition comprising iron and, 0.17-0.35 wt. % carbon, 0.30-2.00 wt. % manganese, 0.10-0.30 wt. % silicon, 0.010-0.040 wt. % aluminum, up to 0.010 wt. % sulfur, and up to 0.015 wt. % phosphorus, and a final microstructure comprising a mixture of tempered martensite and bainite, wherein the final microstructure of the coiled tube comprises more than 90 volume % tempered martensite in the base metal regions, the weld joints, and the heat affected zones, wherein the final microstructure across all base metal regions, weld joints, and heat affected zones is homogeneous, and wherein the final microstructure comprises a uniform distribution of fine carbides across the base metal regions, the weld joints, and the heat affected zones.

In some embodiments, the composition further comprises, up to 1.0 wt. % chromium, up to 0.5 wt. % molybdenum, up to 0.0030 wt. % boron, up to 0.030 wt. % titanium, up to 0.50 wt. % copper, up to 0.50 wt. % nickel, up to 0.1 wt. % niobium, up to 0.15 wt. % vanadium, up to 0.0050 wt. % oxygen, and up to 0.05 wt. % calcium.

In some embodiments, the composition can comprise 0.17 to 0.30 wt. % carbon, 0.30 to 1.60 wt. % manganese, 0.10 to 0.20 wt. % silicon, up to 0.7 wt. % chromium, up to 0.5 wt. % molybdenum, 0.0005 to 0.0025 wt. % boron, 0.010 to 0.025 wt. % titanium, 0.25 to 0.35 wt. % copper, 0.20 to 0.35 wt. % nickel, up to 0.04 wt. % niobium, up to 0.10 wt. % vanadium, up to 0.0015 wt. % oxygen, up to 0.03 wt. % calcium, up to 0.003 wt. % sulfur; and up to 0.010 wt. % phosphorus.

In some embodiments, the tube can have a minimum yield strength of 125 ksi. In some embodiments, the tube can have a minimum yield strength of 140 ksi. In some embodiments, the tube can have a minimum yield strength of between 125 ksi and 140 ksi.

In some embodiments, the final microstructure can comprise at least 95 volume % tempered martensite in the base metal regions, the weld joints, and the heat affected zones. In some embodiments, the tube can have a final grain size of below 20 μm in the base metal regions, the weld joints, and the heat affected zones. In some embodiments, the tube can have a final grain size of below 15 μm in the base metal regions, the weld joints, and the heat affected zones.

In some embodiments, the weld joints can comprise bias welds. In some embodiments, the fatigue life at the bias welds can be at least about 80% of the base metal regions. In some embodiments, the a percent hardness of a weld joint, including its heat affected zone, can be 110% or less than a hardness of the base metal.

Also disclosed herein is a method of forming a coiled steel tube which can comprise providing strips having a composition comprising iron and 0.17-0.35 wt. % carbon, 0.30-2.00 wt. % manganese, 0.10-0.30 wt. % silicon, 0.010-0.040 wt. % aluminum, up to 0.010 wt. % sulfur, up to 0.015 wt. % phosphorus, and welding the strips together, forming a tube from the welded strips, wherein the tube comprises base metal regions, joint welds, and their heat affected zones, austenitizing the tube between 900-1000° C., quenching the tube to form a final as quenched microstructure of martensite and bainite, wherein the as quenched microstructure comprises at least 90% martensite in the base metal regions, the weld joints, and the heat affected zones, and tempering the quenched tube between 550-720° C., wherein tempering of the quenched tube results in a yield strength greater than about 80 ksi, wherein the microstructure across all base metal regions, weld joints, and the heat affected zones is homogeneous, and wherein the microstructure comprises a uniform distribution of fine carbides across the base metal regions, the weld joints, and the heat affected zones.

In some embodiments, the welding the strips can comprise bias welding. In some embodiments, the forming the tube can comprise forming a line joint. In some embodiments, the method can further comprise coiling the tempered tube on a spool. In some embodiments, the austenitizing can form a grain size below 20 μm in the base metal regions, the weld joints, and the heat affected zones.

In some embodiments, the composition can further comprise up to 1.0 wt. % chromium up to 0.5 wt. % molybdenum up to 0.0030 wt. % boron, up to 0.030 wt. % titanium, up to 0.50 wt. % copper, up to 0.50 wt. % nickel, up to 0.1 wt. % niobium, up to 0.15 wt. % vanadium, up to 0.0050 wt. % oxygen, and up to 0.05 wt. % calcium.

In some embodiments, the composition can comprise 0.17 to 0.30 wt. % carbon, 0.30 to 1.60 wt. % manganese, 0.10 to 0.20 wt. % silicon, up to 0.7 wt. % chromium, up to 0.5 wt. % molybdenum, 0.0005 to 0.0025 wt. % boron, 0.010 to 0.025 wt. % titanium, 0.25 to 0.35 wt. % copper, 0.20 to 0.35 wt. % nickel, up to 0.04 wt. % niobium, up to 0.10 wt. % vanadium, up to 0.00015 wt. % oxygen, up to 0.03 wt. % calcium, up to 0.003 wt. % sulfur, and up to 0.010 wt. % phosphorus.

In some embodiments, the tempered tube can have a yield strength greater than or equal to 125 ksi. In some embodiments, the tempered tube can have a minimum yield strength of 140 ksi. In some embodiments, the tempered tube can have a minimum yield strength between 125 and 140 ksi.

BRIEF DESCRIPTION OF THE DRAWINGS

FIGS. 5A-B correspond to a conventional coiled tube Grade 90.

FIGS. 11A-B illustrate microstructures corresponding to HAZ of the bias weld for the standard coiled tube (A) and a coiled tube manufactured from embodiments of the present disclosure (B). In both cases the coiled tubing tensile properties correspond to a Grade 110 (yield strength from 110 Ksi to 120 Ksi).

DETAILED DESCRIPTION

Figure 1A:
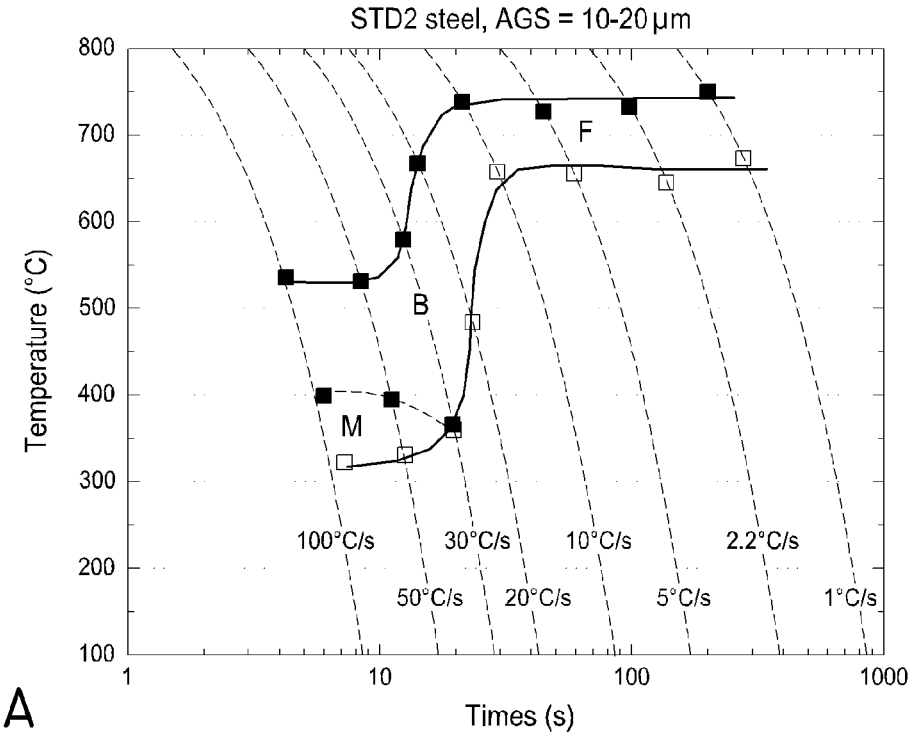
FIGS. 1A-B illustrate CCT diagrams corresponding to STD2 (A) and STD3 (B) steels.

Coiled Tubing raw material is produced in a steel shop as hot rolled strips. Controlled rolling is used to guarantee high strength and good toughness through microstructural refinement. The strips are longitudinally cut to the width for pipe production, and then spliced end to end through a joining process (e.g. Plasma Arc Welding or Friction Stir Welding) to form a longer strip. Afterwards, the tube is formed using the ERW process. The final product performance is measured in terms of: a) axial mechanical properties, b) uniformity of microstructure and properties, c) toughness, d) fatigue resistance, e) sour resistance, among others. Using the traditional processing route, the coiled tubing mechanical properties result from the combination of the hot-rolled strip properties and the modifications introduced during welding operations and tube forming. The properties thus obtained are limited when coiled tube performance is measured as listed above. The reason being is that the welding process used to join the strips modifies the refined as-rolled microstructure in a way that, even if a post weld heat treatments is applied, final properties are still impaired. Reduced fatigue life and poor sour performance is associated to heterogeneities in microstructure and presence of brittle constituents across the welds. It has been proposed that a new route should at least comprise a full body heat treatment. This route has been described in general terms but never specified. The disclosure describes the chemistries and raw material characteristics, that combined with appropriated welding processes, and heat treatment conditions, will yield a quenched and tempered product with high performance in both pipe body and strip joining welds. This material is designed for coiled tubing since it is selected not only in terms of relative cost, but preferably in order to maximize fatigue life under the particular conditions that apply to the operation of coiled tubing (low cycle fatigue under bending with simultaneous axial load and internal pressures).

This disclosure is related to a high strength coiled tubing (minimum yield strength ranging from 80 ksi to 140 ksi) having increased low-cycle fatigue life in comparison with standard products, as defined by API 5ST. Additionally, Sulfide Stress Cracking (SSC) resistance is also improved in this disclosure. This outstanding combination of properties is obtained through an appropriate selection of steel chemistry and processing conditions. Industrial processing differs from the standard route in the application of a Full Body Heat Treatment (FBHT), as was disclosed in U.S. App. No. US2012/0186686 A1. This FBHT is performed after the coiled tubed is formed by ERW (Electrical Resistance Welding) and is composed of at least one cycle of austenitization, quenching and tempering. The above mentioned disclosure is more specifically related to the steel chemistries and processing parameters to produce a quenched and tempered coiled tubing with the above mentioned properties. Although the generation of certain mechanical properties through a heat treatment on a base material with a given composition are part of the general knowledge, the particular application for coiled tubing uses raw material with specific chemistry in order to minimize the detrimental effect of particular variables, such us segregation patterns, on the specific properties of this application.

One of the most important properties to the coiled tube is an increased resistance to low cycle fatigue. This is because during standard field operation coiled tubes are spooled and unspooled frequently, introducing cyclic plastic deformations that may eventually produce failures. During low cycle fatigue, deformation is preferentially localized at the microscopical scale in softer material regions. When brittle constituents are present at or close to these strain concentration regions, cracks can easily nucleate and propagate. Therefore, a reduction in fatigue life is associated with heterogeneous microstructures (having softer regions that localize deformation) in combination with brittle constituents (that nucleate and/or propagate cracks). All these micro-structural features appear in the Heat Affected Zone of the welds (HAZ). There are some types of pipe body microstructures that also present the above mentioned characteristics. This is because they are composed of a mixture of hard and soft constituents, for example ferrite, pearlite and bainite. In this case strain is localized in the softer ferrite, close to the boundary with bainite, in which cracks are nucleated and propagated. High strength coiled tubes have currently this type of microstructure.

In order to avoid strain localization during low cycle fatigue the microstructure has to be not only homogeneous throughout the pipe body and joints, but also in the microscopic scale. For low carbon steels a microstructure composed of tempered martensite, which is basically a ferrite matrix with a homogeneous and fine distribution of carbides, is ideal. Thereafter, the objective of the chemistry selection and processing conditions described in this disclosure is to achieve with the FBHT a homogeneous microstructure (in tube body, bias weld and ERW line) composed of at least 90% tempered martensite, preferably more than 95% tempered martensite.

Additionally, tempered martensite is more suitable to produce ultra-high strength grades than standard coiled tube microstructures (composed of ferrite, pearlite and bainite), for which extremely costly alloying additions are needed to reach yield strengths higher than about 125 Ksi.

When compared with structures containing bainite, other important benefits of tempered martensite is its improved SSC resistance.

Steel chemistry has been defined as the most suitable for production of heat treated coiled tubing using a FBHT, and can be described in terms of concentration of Carbon (wt % C), Manganese (w % Mn), Silicon (w % Si), Chromium (wt % Cr), Molybdenum (w % Mo), as well as micro-alloying elements as Boron (w % B), Titanium (w % Ti), Aluminum (w % Al), Niobium (w % Nb) and Vanadium (w % V). Also, upper limits can be on unavoidable impurities as Sulfur (w % S), Phosphorus (w % P) and Oxygen (w % O).

In order to produce a final structure composed of tempered martensite, the steel chemistry of this disclosure differs mainly from previous coiled tube art because of the higher Carbon content (see for example API 5ST in which maximum Carbon allowed for Coiled tubing is 0.16%), which allows for obtaining the desired microstructure through a FBHT composed of at least one cycle of austenitization, quenching and tempering.

The terms "approximately", "about", and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

Carbon is an element whose addition inexpensively raises the strength of the steel through an improvement in hardenability and the promotion of carbide precipitation during heat treatments. If carbon is reduced below 0.17% hardenability could not be guaranteed, and large fractions of bainite may be formed during heat treatments. The appearance of bainite makes it difficult to reach a yield strength above 80 ksi with the desired fatigue life and SSC resistance. Current coiled tubing route is not suitable for heat treatment since the maximum Carbon allowed by API5ST is 0.16%. Conventional coiled tubing microstructures present large fractions of bainite that impair toughness, fatigue life and SSC resistance in the higher strength grades, i.e. coiled tubings with minimum yield strength above 110 Ksi.

On the other hand, steels with more than 0.35% carbon will have poor weldability, being susceptible to present brittle constituents and cracks during welding and post-weld heat treatment operations. Additionally, higher carbon contents may result in significant amounts of retained austenite after quenching that transform into brittle constituents upon tempering. These brittle constituents impair fatigue life and SSC resistance. Therefore, the C content of the steel composition varies within the range from about 0.17% to about 0.35%, preferably from about 0.17% to about 0.30%.

Manganese addition improves hardenability and strength. Mn also contributes to deoxidation and sulfur control during the steelmaking process. If Mn content is less than about 0.30%, it may be difficult to obtain the desired strength level. However, as Mn content increases, large segregation patterns may be formed. Mn segregated areas will tend to form brittle constituents during heat treatment that impair toughness and reduce fatigue. Additionally, these segregated areas increase the material susceptibility to sulfide stress cracking (SSC). Accordingly, the Mn content of the steel composition varies within the range from 0.30% to 2.0%, preferably from 0.30% to 1.60%, and more preferably from 0.30% to 0.80% in application for which an improved SSC resistance is used.

Silicon is an element whose addition has a deoxidizing effect during the steel making process and also raises the strength of the steel. In some embodiments, if Si exceeds about 0.30%, the toughness may decrease. Additionally, large segregation patterns may be formed. Therefore, the Si content of the steel composition varies within the range between about 0.10% to 0.30%, preferably about 0.10% to about 0.20%.

Chromium addition increases hardenability and tempering resistance of the steel. Cr can be used to partially replace Mn in the steel composition in order to achieve high strength without producing large segregation patterns that impair fatigue life and SSC resistance. However, Cr is a costly addition that makes the coiled tubing more difficult to produce because of its effects on hot forming loads. Therefore, in some embodiments Cr is limited to about 1.0%, preferably to about 0.7%.

Molybdenum is an element whose addition is effective in increasing the strength of the steel and further assists in retarding softening during tempering. The resistance to tempering allows the production of high strength steels with reduced Mn content increasing fatigue life and SSC resistance. Mo additions may also reduce the segregation of phosphorous to grain boundaries, improving resistance to inter-granular fracture. However, this ferroalloy is expensive, making it desirable to reduce the maximum Mo content within the steel composition. Therefore, in certain embodiments, maximum Mo is about 0.5%.

Boron is an element whose addition is strongly effective in increasing the hardenability of the steel. For example, B may improve hardenability by inhibiting the formation of ferrite during quenching. In some embodiments, B is used to achieve good hardenability (i.e. as quenched structure composed of at least 90% martensite) in steels with Mn content reduced to improve fatigue life and SSC resistance. If the B content is less than about 0.0005 wt. % it may be difficult in these embodiments to obtain the desired hardenability of the steel. However, if the B content too high, coarse boron carbides may be formed at grain boundaries adversely affecting toughness. Accordingly, in an embodiment, the concentration of B in the composition lower than about 0.0030%, in another embodiment B content is from about 0.0005% to 0.0025%.

Titanium is an element whose addition is effective in increasing the effectiveness of B in the steel, by fixing nitrogen impurities as Titanium Nitrides (TiN) and inhibiting the formation of Boron nitrides. If the Ti content is too low it may be difficult in some embodiments to obtain the desired effect of boron on hardenability of the steel. On the other hand, if the Ti content is higher than 0.03 wt % coarse Titanium nitrides and carbides (TiN and TiC) may be formed, adversely affecting ductility and toughness. Accordingly, in certain embodiments, the concentration of Ti may be limited to about 0.030%. In other embodiments, the concentration of Ti may range from about 0.010% to about 0.025%.

Considering that the production of coiled tubing of low mechanical properties benefits from low tempering resistance, B and Ti additions improve hardenability without increasing tempering resistance. Thereafter it allows for the production of 80 ksi grade without significant large soaking times during tempering, with the subsequent improvement in productivity. Since one of the limitations for the production of a coiled tubing in a heat treatment line is the length of the line to adequately soak the material during tempering, the use of B and Ti is particularly relevant to the production of low yield strength coiled tubing.

Copper is an element that is not required in certain embodiments of the steel composition. However, in some coiled tubing applications Cu may be needed to improve atmospheric corrosion resistance. Thus, in certain embodiments, the Cu content of the steel composition may be limited to less than about 0.50%. In other embodiments, the concentration of Cu may range from about 0.25% to about 0.35%.

Nickel is an element whose addition increases the strength and toughness of the steel. If Cu is added to the steel composition, Ni can be used to avoid hot rolling defects known as hot shortness. However, Ni is very costly and, in certain embodiments, the Ni content of the steel composition is limited to less than or equal to about 0.50%. In other embodiments, the concentration of Ni may range from about 0.20% to about 0.35%.

Niobium is an element whose addition to the steel composition may refine the austenitic grain size of the steel during reheating into the austenitic region, with the subsequent increase in both strength and toughness. Nb may also precipitate during tempering, increasing the steel strength by particle dispersion hardening. In an embodiment, the Nb content of the steel composition may vary within the range between about 0% to about 0.10%, preferably about 0% to about 0.04%.

Vanadium is an element whose addition may be used to increase the strength of the steel by carbide precipitations during tempering. However if V content of the steel composition is greater than about 0.15%, a large volume fraction of vanadium carbide particles may be formed, with an attendant reduction in toughness of the steel. Therefore, in certain embodiments, the V content of the steel is limited to about 0.15%, preferably to about 0.10%.

Aluminum is an element whose addition to the steel composition has a deoxidizing effect during the steel making process and further refines the grain size of the steel. In an embodiment, if the Al content of the steel composition is less than about 0.010%, the steel may be susceptible to oxidation, exhibiting high levels of inclusions. In other embodiments, if the Al content of the steel composition greater than about 0.040%, coarse precipitates may be formed that impair the toughness of the steel. Therefore, the Al content of the steel composition may vary within the range between about 0.010% to about 0.040%.

Sulfur is an element that causes the toughness and workability of the steel to decrease. Accordingly, in some embodiments, the S content of the steel composition is limited to a maximum of about 0.010%, preferably about 0.003%.

Phosphorus is an element that causes the toughness of the steel to decrease. Accordingly, the P content of the steel composition limited to a maximum of about 0.015%, preferably about 0.010%.

Oxygen may be an impurity within the steel composition that is present primarily in the form of oxides. In an embodiment of the steel composition, as the O content increases, impact properties of the steel are impaired. Accordingly, in certain embodiments of the steel composition, a relatively low O content is desired, less than or equal to about 0.0050 wt %; preferably less than or equal to about 0.0015 wt %.

Calcium is an element whose addition to the steel composition may improve toughness by modifying the shape of sulfide inclusions. In an embodiment, the steel composition may comprise a minimum Ca to S content ratio of Ca/S>1.5. In other embodiments of the steel composition, excessive Ca is unnecessary and the steel composition may comprise a maximum content Ca of about 0.05%, preferably about 0.03%.

The contents of unavoidable impurities including, but not limited to N, Pb, Sn, As, Sb, Bi and the like are preferably kept as low as possible. However, properties (e.g., strength, toughness) of steels formed from embodiments of the steel compositions of the present disclosure may not be substantially impaired provided these impurities are maintained below selected levels. In one embodiment, the N content of the steel composition may be less than about 0.010%, preferably less than or equal to about 0.008%. In another embodiment, the Pb content of the steel composition may be less than or equal to about 0.005%. In a further embodiment, the Sn content of the steel composition may be less than or equal to about 0.02%. In an additional embodiment, the As content of the steel composition may be less than or equal to about 0.012%. In another embodiment, the Sb content of the steel composition may be less than or equal to about 0.008%. In a further embodiment, the Bi content of the steel composition may be less than or equal to about 0.003%.

The selection of a specific steel chemistry of this disclosure will depend on the final product specification and industrial facility constrains (for example in induction heat treatment lines it is difficult to achieve large soaking times during tempering). Mn addition will be reduced when possible because it impairs fatigue life and SSC resistance through the formation of large segregation patterns. Cr and to a less extent Mo will be used to replace Mn, and the full body heat treatment is kept as simple as possible. Both elements increase carbide stability and softening resistance, which may lead to large soaking times during tempering. Thereafter, these elements are preferred for the higher strength grades (for example Grade 110 and above) for which tempering resistance is desired, and avoided in the lower ones (Grade 80) for which long and impractical industrial heat treatment lines would be needed.

In the case of the lower grades (Grade 80), it will be preferred B and Ti microalloyed additions in combination with suitable C contents. These elements allow for achieving good hardenability without the use of high Mn additions. Moreover, B and Ti do not increase tempering resistance. Thereafter, simple and short tempering treatment can be used to achieve the desired strength level.

The industrial processing route corresponding to this disclosure is described in the following paragraphs, making focus on the Full Body Heat Treatment (FBHT) conditions.

Raw material for coiled tubing is produced in a steel shop as hot rolled strips with wall thickness that may vary from about 0.08 inches to about 0.30 inches. Controlled rolling may be used by the steel supplier to refine the as rolled microstructure. However, an important microstructural refinement of the as rolled strips is not needed, because in this disclosure microstructure and mechanical properties are mostly defined by the final FBHT. This flexibility in the hot rolling process helps to reduce raw-material cost, and allows to use steel chemistries not available when complex hot rolling procedures can be used (in general controlled rolling can be applied only to low carbon micro-alloyed steels).

The steel strips are longitudinally cut to the width for pipe production. Afterwards, the strips are joined end to end through a welding process (e.g. Plasma Arc Welding or Friction Stir Welding) to form a longer strip that allows to achieve the pipe length. These welded strips are formed into a pipe using, for example an ERW process. Typical coiled tube outer diameters are between 1 inch and 5 inches. Pipe lengths are about 15,000 feet, but lengths can be between about 10,000 feet to about 40,000 feet.

After forming the pipe, the Full Body Heat Treatment (FBHT) is applied. The objective of this heat treatment is to produce a homogeneous final microstructure composed of at least 90% tempered martensite, the rest being bainite. This microstructure, having uniform carbide distribution and grain size below 20 μm—preferably below 15 guarantees good combinations of strength, ductility, toughness and low cycle fatigue life. Furthermore, as was previously mentioned, by properly selecting the steel chemistry this type of microstructure is suitable to improve Sulfide Stress Cracking (SSC) resistance in comparison with conventional structures, composed of ferrite, pearlite and large volume fractions of upper bainite.

The FBHT is composed of at least one austenitization and quenching cycle (Q) followed by a tempering treatment (T). The austenitization is performed at temperatures between 900° C. and 1000° C. During this stage the total time of permanence above the equilibrium temperature Ae3 should be selected to guarantee a complete dissolution of iron carbides without having excessive austenitic grain growth. The target grain size is below 20 μM, preferably below 15 μm. Quenching has to be performed controlling the minimum cooling rate in order to achieve a final as quenched microstructure composed of at least 90% martensite throughout the pipe.

Tempering is carried out at temperatures between 550° C. and 720° C. Heat treatment above 720° C. may led to partial martensite transformation to high carbon austenite. This constituent has to be avoided because tends to transform into brittle constituents, which may impair toughness and fatigue life. On the other hand, if tempering is performed below 550° C. the recovery process of the dislocated as quenched structure is not complete. Thereafter, toughness may be again strongly reduced. The tempering cycle has to be selected, within the above mentioned temperature range, in order to achieve the desired mechanical properties. Minimum yield strength may vary from 80 ksi to 140 ksi. An appropriate time of permanence at temperature has to be selected to guarantee an homogeneous carbide distribution in both base tube and weld areas (ERW line and strip to strip joints). In some cases, in order to improve the combination of strength and toughness more than one austenitization, quenching and tempering cycles may be performed. After FBHT the pipe may be subjected to a sizing process, in order to guarantee specified dimensional tolerances, stress relieved and spooled into a coil.

EXAMPLES

Example A: Chemistry Selection to Improve Hardenability

As was previously mentioned, the microstructure of this disclosure is composed of at least 90% tempered martensite with an homogenous distribution of fine carbides, the rest being bainite. This microstructure allows for production of a coiled tube with the desired combination of high strength, extended low cycle fatigue life and improved SSC resistance.

The tempered martensite is obtained by at least one heat treatment of quenching and tempering, performed after the pipe is formed by ERW. The heat treatment may be repeated two or more times if additional refinement is desired for improving SSC resistance. This is because subsequent cycles of austenization and quenching reduce not only prior austenitic grain size, but also martensite block and packet sizes.

To obtain the target microstructure with good hardenability, at least 90% martensite has to be formed at the end of the quenching process. An adequate chemistry selection is paramount to achieve such volume fraction of martensite. The selection of suitable steel compositions was based on results from experiments performed with a thermo-mechanical simulator Gleeble® 3500. Industrial trials were performed afterwards to confirm laboratory findings.

Some of the steel chemistries analyzed in laboratory are listed in Table A1. For all these chemistries dilatometric tests were carried out at Gleeble® to construct Continuous Cooling Transformation (CCT) diagrams. The CCT diagrams were used, in combination with metallographic analysis of the samples obtained from the simulations, to determine the minimum cooling rate to have more than 90% martensite. This critical cooling rate, mainly dependent on steel chemistry, will be referred as CR90.

TABLE A1

Chemical composition of the steels experimentally studied. Element concentrations are in weight percent (wt %).

| Steel | C | Mn | Si | Cr | Mo | Ni | Cu | Other |
|---|---|---|---|---|---|---|---|---|
| STD1 | 0.13 | 0.80 | 0.35 | 0.52 | — | 0.15 | 0.28 | Ti |
| STD2 | 0.14 | 0.80 | 0.33 | 0.55 | 0.10 | 0.17 | 0.27 | Nb Ti |
| STD3 | 0.14 | 0.80 | 0.34 | 0.57 | 0.32 | 0.22 | 0.28 | Nb Ti |
| CMn1 | 0.17 | 2.00 | 0.20 | — | — | — | — | — |
| CMn2 | 0.25 | 1.60 | 0.20 | — | — | — | — | — |
| BTi1 | 0.17 | 1.60 | 0.20 | — | — | — | — | B Ti |
| BTi2 | 0.25 | 1.30 | 0.20 | — | — | — | — | B Ti |
| CrMo1 | 0.17 | 1.00 | 0.25 | 1.00 | 0.50 | — | — | — |
| CrMo2 | 0.25 | 0.60 | 0.20 | 1.00 | 0.50 | — | — | — |
| CrMoBTi1 | 0.17 | 0.60 | 0.20 | 1.00 | 0.50 | — | — | B Ti |
| CrMoBTi2 | 0.24 | 0.40 | 0.15 | 1.00 | 0.25 | — | — | B Ti |
| CrMoBTi3 | 0.24 | 0.40 | 0.15 | 1.00 | 0.50 | — | — | B Ti |
| CrMoBTi4 | 0.26 | 0.60 | 0.15 | 0.50 | 0.25 | | | B Ti |

Examples of obtained CCT diagrams are presented in FIGS. 1-2. In all cases the austenitization was performed at 900-950° C. in order to obtain a fine austenitic grain size (AGS) of 10-20 μm. STD1, STD2 and STD3 steels have chemistries within API 5ST specification, but outside the range of this disclosure because of their low carbon addition (Table A1). The critical cooling CR90 was greater than 100° C./sec in the case of STD1 and STD2, and about 50° C./sec for STD3.

Figure 1B:
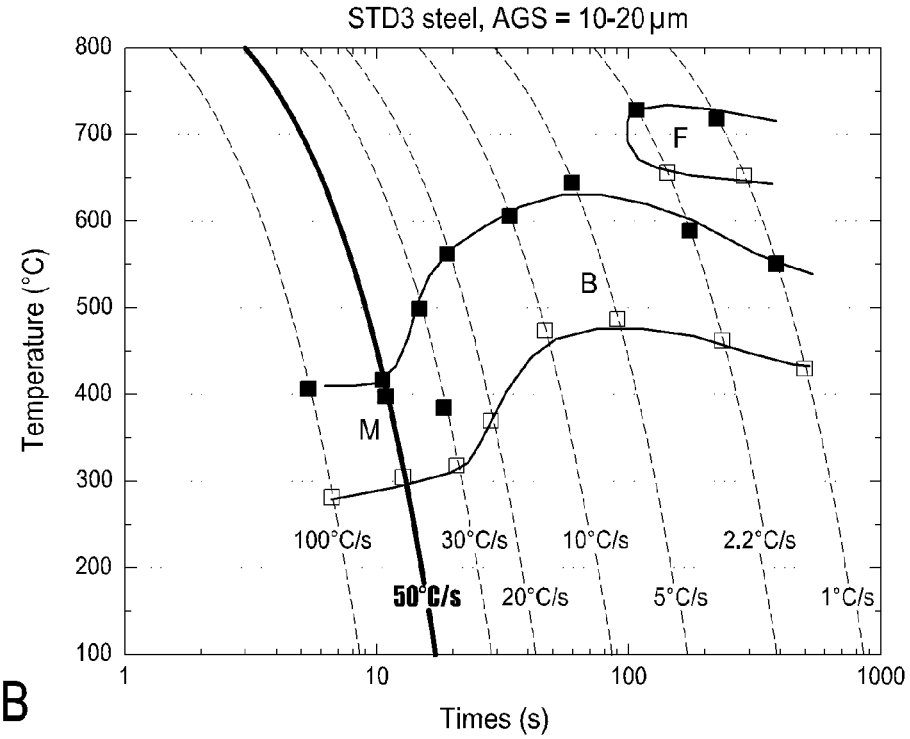
Figure 2A:
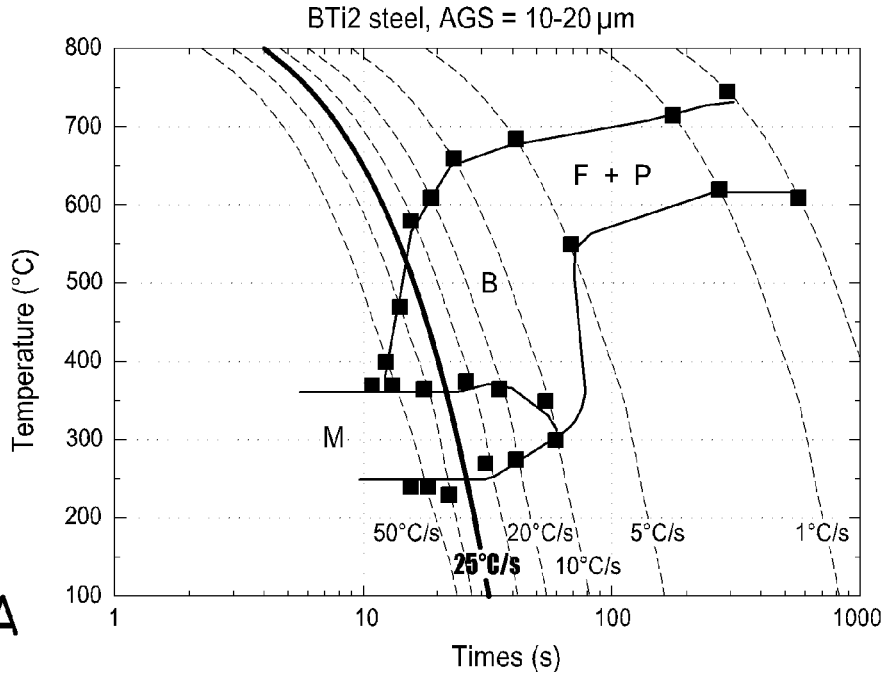
FIGS. 2A-B illustrate CCT diagrams corresponding to $BTi_2$ (A) and $CrMoBTi_3$ (B) steels.
Figure 2B:
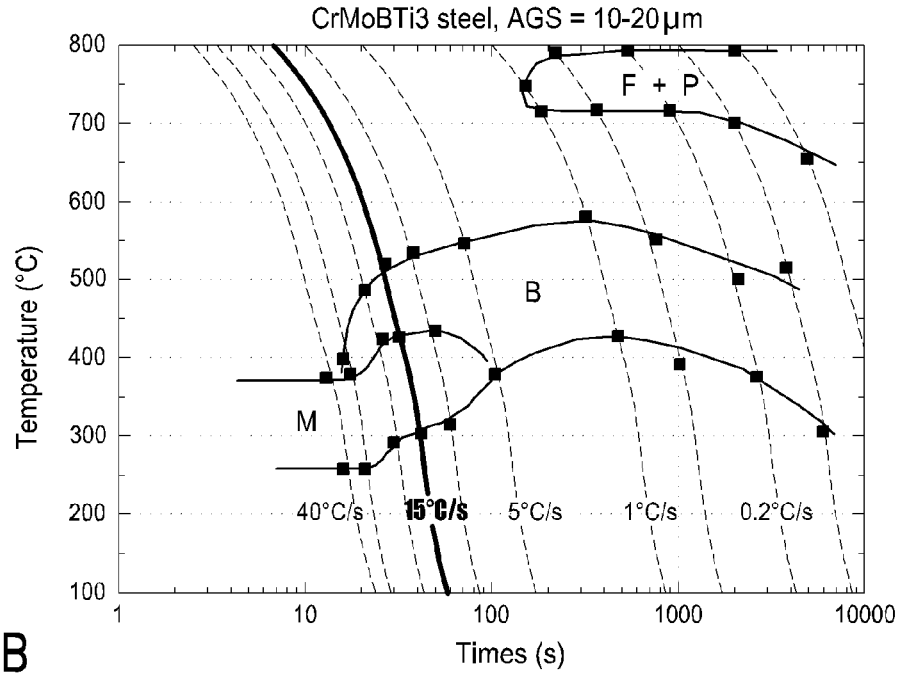

FIGS. 1A-B show CCT diagrams corresponding to STD2 (A) and STD3 (B) steels. In bold is shown the critical cooling conditions to produce a final microstructure composed of about 90% martensite, the rest being bainite. FIGS. 2A-B show the CCT diagrams corresponding to $BTi_2$ and $CrMoBTi_3$ steels. In bold are shown the critical cooling conditions to produce final microstructures composed of about 90% martensite, the rest being bainite. The first one is a C—Mn steel microalloyed with B—Ti (see Table A1). $CrMoBTi_2$ is a medium carbon steel having Cr and Mo additions, also microalloyed with B—Ti. The measured critical cooling rates (corresponding to the cooling curves shown in bold in the CCT diagrams) were 25° C./s and 15° C./s for $BTi_2$ and $CrMoBTi_3$, respectively.

Figure 3:
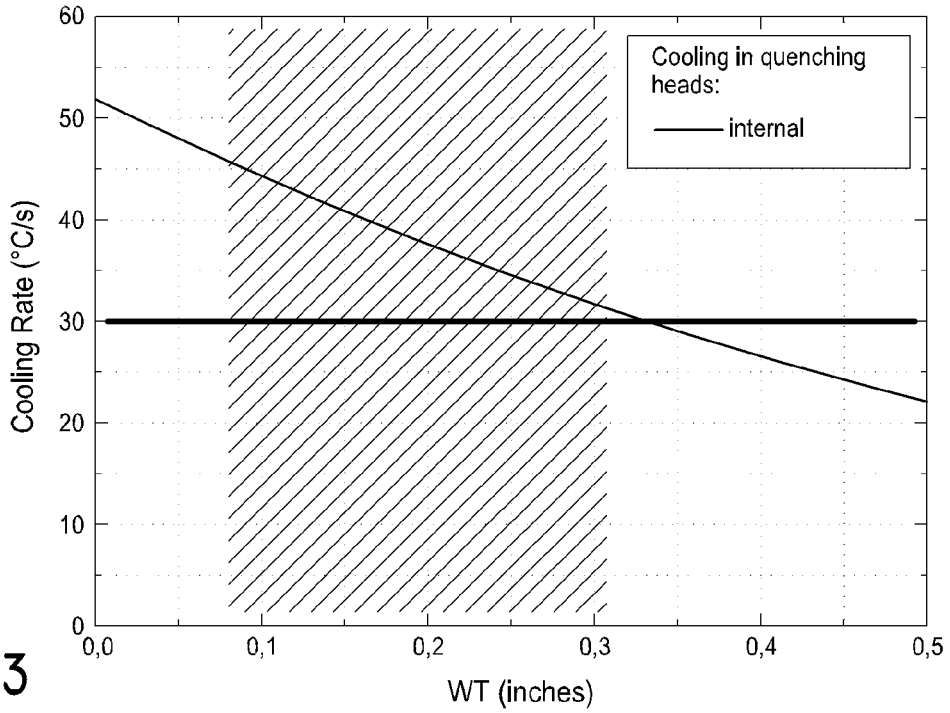
FIG. 3 illustrates a cooling rate at an internal pipe surface as a function of the wall thickness (WT) for a coiled tube quenched from the external with water sprays.

In FIG. 3 is presented the average cooling rate of pipes treated in an industrial quenching heads facility (sprays of water cooling the tube from the external surface). Values are shown as a function of the pipe Wall Thickness (WT). The shaded area in the plot corresponds to the wall thickness range typical of coiled tube applications. It is clear that when selecting steel chemistries suitable to have more than 90% tempered martensite, the critical cooling rate of the alloy should be equal or lower than 30° C./s. Otherwise, more than 10% bainite will be formed during quenching the thicker tube (WT=0.3 inches) in the above mentioned facility.

STD1, STD2 and STD3 have critical cooling rates above 30° C./s, thereafter these steels are not suitable for this disclosure. On the other hand, hardenability is adequate in $BTi_2$ and $CrMoBTi_3$ steels. The hardenability improvement is due to an increased carbon content and the B—Ti addition.

In Table A2 is shown the critical cooling rates measured for the steels of Table A1. STD1, STD2 and STD3 are chemistries currently used for coiled tubes grades 80, 90 and 110; and fulfill API 5ST. However, even the more alloyed STD3 have a critical cooling rate to guarantee more than 90% tempered martensite in pipes with WT in the range of interest. It is clear that standard materials are not adequate to produce the target microstructure of this disclosure and hardenability has to be improved. In low alloy steels the most important element affecting hardenability is Carbon. Thereafter, C was increased above the maximum specified by API 5ST (0.16 wt. %) to have critical cooling rates not higher than 30° C./s. In this disclosure Carbon addition is in the range from 0.17% to 0.35% (the maximum level was selected to guarantee good weldability and toughness). As was just mentioned, the rest of the chemistry has to be adjusted to have CR90 values equal or lower than 30° C./s.

TABLE A2

Critical cooling rates to have more than 90% martensite (CR90) measured for the analyzed steels. Values determined from Gleeble ® dilatometric tests and metallographic analysis.

| Steel | C (wt %) | Mn (wt %) | Si (wt %) | Cr (wt %) | Mo (wt %) | Other | CR90 (° C./s) | Adequate hardenability? |
|---|---|---|---|---|---|---|---|---|
| STD1 | 0.13 | 0.80 | 0.35 | 0.52 | 0.13 | Ni, Cu, Ti | >100 | No |
| STD2 | 0.14 | 0.80 | 0.33 | 0.55 | 0.10 | Ni,Cu, Nb—Ti | >100 | No |
| STD3 | 0.14 | 0.80 | 0.34 | 0.57 | 0.32 | Ni,Cu, Nb Ti | 50 | No |
| CMn1 | 0.17 | 2.00 | 0.20 | — | — | — | 30 | Yes |
| CMn2 | 0.25 | 1.60 | 0.20 | — | — | — | 30 | Yes |
| BTi1 | 0.17 | 1.60 | 0.20 | — | — | B Ti | 30 | Yes |
| BTi2 | 0.25 | 1.30 | 0.20 | — | — | B Ti | 25 | Yes |
| CrMo1 | 0.17 | 1.00 | 0.25 | 1.00 | 0.50 | — | 25 | Yes |
| CrMo2 | 0.25 | 0.60 | 0.20 | 1.00 | 0.50 | — | 23 | Yes |
| CrMoBTi1 | 0.17 | 0.60 | 0.20 | 1.00 | 0.50 | B Ti | 25 | Yes |
| CrMoBTi2 | 0.24 | 0.40 | 0.15 | 1.00 | 0.25 | B Ti | 25 | Yes |
| CrMoBTi3 | 0.24 | 0.40 | 0.15 | 1.00 | 0.50 | B Ti | 15 | Yes |
| CrMoBTi4 | 0.26 | 0.60 | 0.16 | 0.50 | 0.25 | B Ti | 30 | Yes |

The following guidelines for selecting adequate steel chemistries were obtained from the analysis of experimental results in Table A2:

C—Mn steels: hardenability depends mainly on Carbon and Manganese additions. About 2% Mn can be used to achieve the desired hardenability when C is in the lower limit (CMn1 steel). However, Mn is an element which produces strong segregation patterns that may decrease fatigue life. Thereafter, Mn addition is decreased in higher Carbon formulations. For example, when carbon concentration is about 0.25%, 1.6% Mn is enough to achieve the hardenability (CMn2 steel).

B—Ti steels: these alloys are plain carbon steels microalloyed with Boron and Titanium. Due to the increase in hardenability associated to the Boron effect, Mn can be further reduced. For Carbon in the lower limit, about 1.6% Mn can be used to achieve the hardenability. When carbon concentration is about 0.25%, 1.3% Mn is enough to achieve the hardenability ($BTi_2$steel).

Cr—Mo steels: these steels have Cr and Mo additions that are useful to increase tempering resistance, which make them suitable for ultra-high strength grades. Additionally, Cr and Mo are elements that improve hardenability; so Mn addition may be further reduced. However, Cr and Mo are costly additions that reduce the steel hot workability, and their maximum content is limited to 1% and 0.5%, respectively. In one example with Carbon in the lower limit, about 1% Mn can be used to achieve the CR90 (CrMo1). If the steel is also microalloyed with B—Ti, a further reduction in Mn to 0.6% can be performed (CrMoBTi1).

Example B: Chemistry Selection for Different Coiled Tube Grades

To analyze tempering behavior of the steels presented in Table A1, simulations of industrial heat treatments were performed at Gleeble®. Simulations consisted in an austenitization at 900-950° C., quenching at 30° C./sec and tempering. In the particular case of STD1, STD2 and STD3 steels higher cooling rates were used in order to achieve at least 90% martensite during quenching. For STD1 and STD2 a quenching rate of about 150° C./s was used, while for STD3 cooling was at 50° C./s. These higher cooling rates can be achieved in small samples at Gleeble® when external water cooling is applied. After quenching the samples were tempered using two types of cycles:

Peak like cycle: Heating at 50° C./s up to a maximum temperature ($T_{max}$) that was in the range from 550° C. to 720° C. Cooling at about 1.5° C./s down to room temperature. These cycles were intended to simulate actual tempering conditions at induction furnaces, which are characterized by high heating rate, no soaking time at maximum temperature and air cooling.

Isothermal cycle: Heating at 50° C./s up to 710° C., soaking at this temperature during a time that ranged from 1 min to 1 hour and cooling at about 1.5° C./s. This cycle was used to simulate tempering in an industrial line with several soaking inductors or with a tunnel furnace.

In all cases tempering temperature ranged from 550° C. to 720° C. Temperatures higher than 720° C. were avoided because non-desired re-austenitization takes place. On the other hand, if tempering is performed below 550° C., recovery of the dislocated structure is not complete, and the material presents brittle constituents that may impair fatigue life.

Peak-like tempering cycles are preferred to reduce line length and to improve productivity. Thereafter, the feasibility of obtaining a given grade with a specific steel chemistry was mainly determined by the tempering curve obtaining using this type of cycles. If after a peak-like tempering at 720° C. strength is still high for the grade, soaking at maximum temperature can be performed. However, as soaking time increases, larger, more expensive and less productive industrial lines may be needed.

Figure 4:
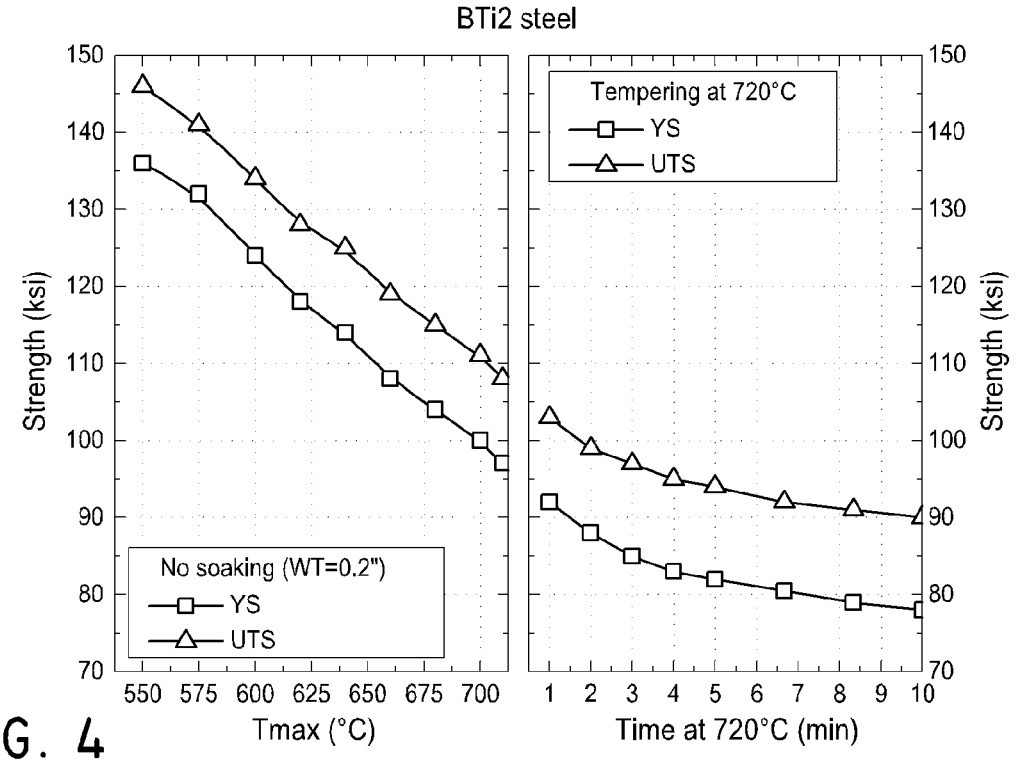
FIG. 4 illustrates tensile properties of $BTi_2$ steel as a function of the maximum tempering temperature ($T_{max}$). Peak-like tempering cycles were used in these Gleeble® simulations. (right) Tensile properties of the same steel as a function of the holding time at 720° C. (isothermal tempering cycles).

In FIG. 4 (inset on the left) is presented the tempering curve measured for $BTi_2$steel. Tensile properties are shown as a function of maximum tempering temperature. Peak-like thermal cycles were used in the simulations. From the figure it is seen that Grades 90 to 125 can be obtained by changing maximum peak temperature from about 710° C. to 575° C., respectively. With this chemistry is not possible to reach 140 Ksi of yield strength without reducing the tempering temperature below 550° C. Regarding the lower grades, 3 minutes of soaking at 710° C. can be used to obtain Grade 80 (inset on the right of FIG. 4).

Based on the results obtained from Gleeble® simulations, Table B1 was constructed. This Table shows, for each analyzed steel, the feasibility of producing different grades, which ranged from 80 Ksi to 140 Ksi of minimum yield strength. For example, in the case of $BTi_2$ it is feasible to reach grades 90 to 125 using peak-like tempering cycles. But 2 minutes of soaking at 720° C. can be used in the case of Grade 80, which is why the in corresponding cell "soaking" is indicated.

TABLE B1

Feasibility of industrially producing Grades 80 to 140 using the steel chemistries analyzed. When "soaking" appears in the cell, it means that more than 1 minute of soaking at 720° C. can be used to reach the grade.

| | Grade 80 | Grade 90 | Grade 110 | Grade 125 | Grade 140 |
|---|---|---|---|---|---|
| | Yield Strength (Ksi) | | | | |
| Steel | 80-90 | 90-100 | 110-125 | 125-140 | 140-155 |
| STD1 | Yes | Yes | no | no | no |
| STD2 | Yes | Yes | yes | no | no |
| STD3 | soaking | Soaking | yes | yes | no |
| CMn1 | soaking | Yes | yes | yes | no |
| CMn2 | soaking | Soaking | yes | yes | no |
| BTi1 | Yes | Yes | yes | no | no |
| BTi2 | soaking | Yes | yes | yes | no |
| CrMo1 | soaking | Soaking | yes | Yes | Yes |
| CrMo2 | soaking | Soaking | soaking | Yes | Yes |
| CrMoBTi1 | soaking | Soaking | yes | Yes | Yes |
| CrMoBTi2 | soaking | Soaking | yes | Yes | Yes |
| CrMoBTi3 | soaking | Soaking | soaking | Yes | Yes |
| CrMoBTi4 | soaking | Soaking | yes | Yes | Yes |

From the results obtained is clear that in order to obtain the higher grades, increased Carbon and Cr—Mo additions can be used. Particularly, Grade 140 cannot be achieved with standard chemistries, as described in API5ST, because of the low Carbon content. On the other hand, to reach Grade 80 a lean chemistry with low carbon, no Cr or Mo additions are the best options. In this case, B—Ti microalloying additions may be used to guarantee good hardenability (for example, a chemistry like $BTi_1$ is a good alternative).

It is important to mention that in order to produce martensitic structures with the standard steels (STD1, STD2 and STD3) it was necessary to use at laboratory higher quenching rates than achievable at the mill. Thereafter, if we limit the cooling rate to that industrially achievable, none of the coiled tube grades can be obtained with conventional steels using the FBHT processing route.

Example C: Chemistry Selection to Reduce Negative Effects of Segregation During Solidification During steel solidification alloying elements tend to remain diluted in the liquid because of its higher solubility in comparison with the solid (6 ferrite or austenite). Solute rich areas form two types of non-uniform chemical composition patterns upon solidification: microsegregation and macrosegregation.

Microsegregation results from freezing the solute-enriched liquid in the interdendritic spaces. But it does not constitute a major problem, since the effects of microsegregation can be removed during subsequent hot working. On the other hand, macrosegregation is non-uniformity of chemical composition in the cast section on a larger scale. It cannot be completely eliminated by soaking at high temperature and/or hot working. In the case of interest for this disclosure, which is the continuous slab cast, it produces the centerline segregation band.

Figure 5A:
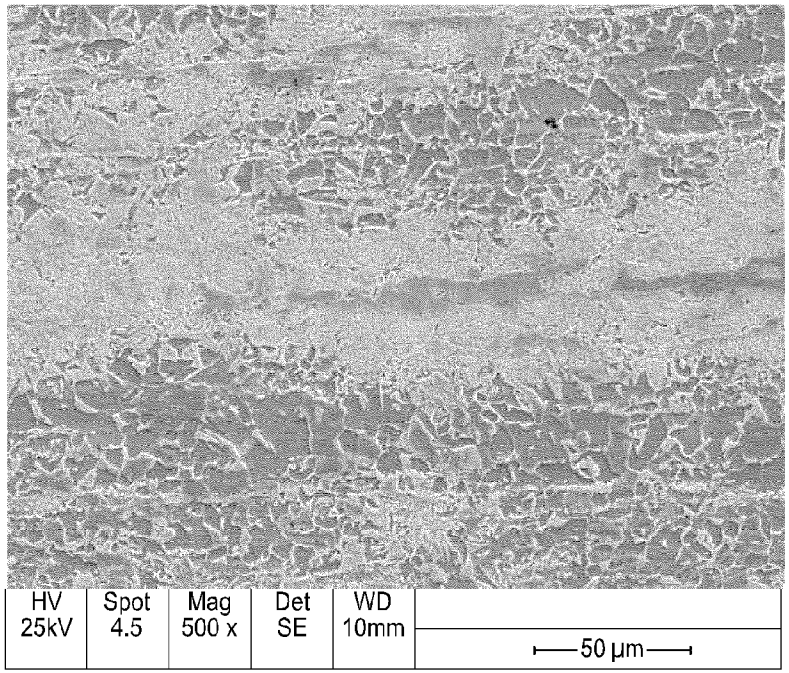
FIGS. 5A-B illustrate non-tempered martensite appearing at the central segregation band close to the ERW line after the seam annealing (PWHT).
Figure 5B:
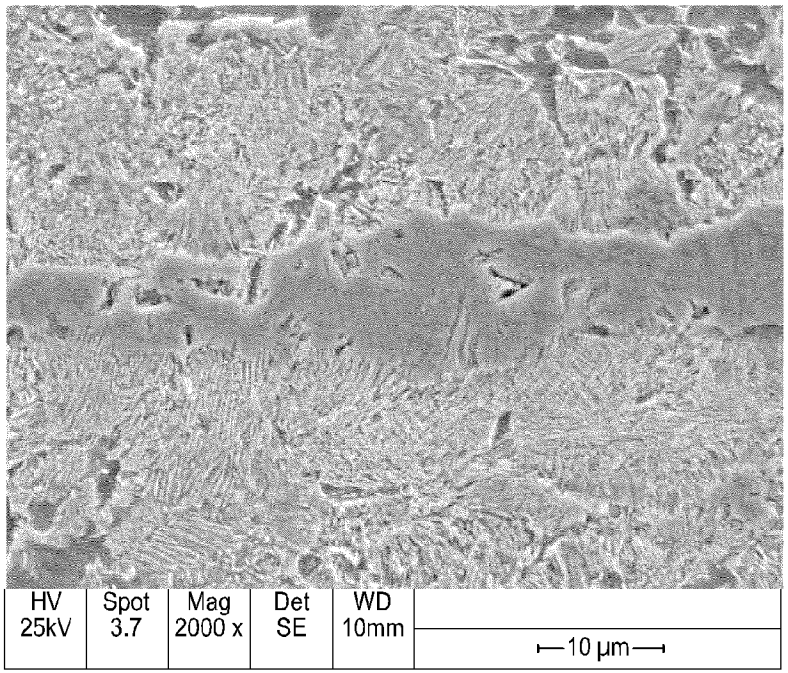

A pronounced central segregation band has to be avoided because:

Brittle constituents as non-tempered martensite may appear in this region as a result of welding operations (bias weld and ERW, see for example FIGS. 5A-B). These non-desired constituents are removed during the subsequent full body heat treatment. However, the tube may be plastically deformed by bending between welding and heat treatment operations, producing a failure during industrial production.

Figure 6B:
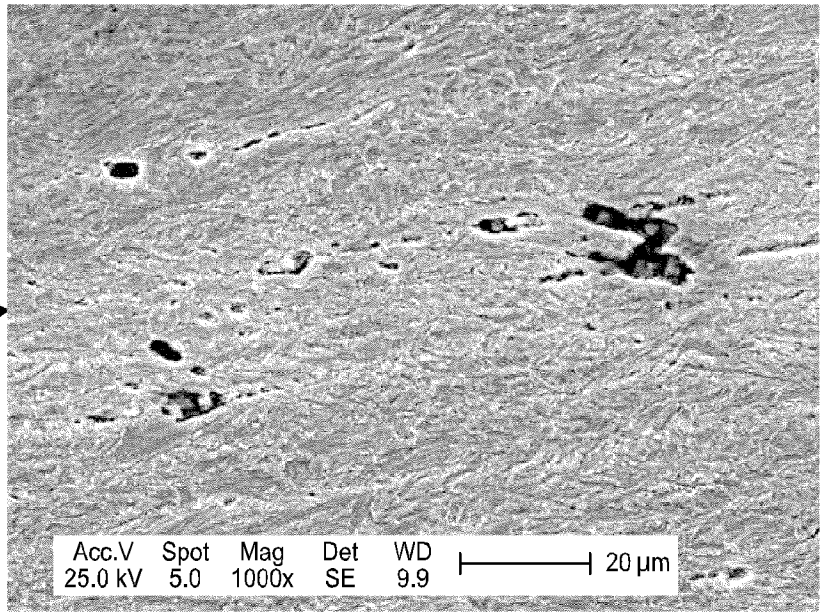
FIGS. 6A-B illustrate localized damage at the central segregation band produced during fatigue testing of a Grade 110 coiled tubing.
Figure 6A:
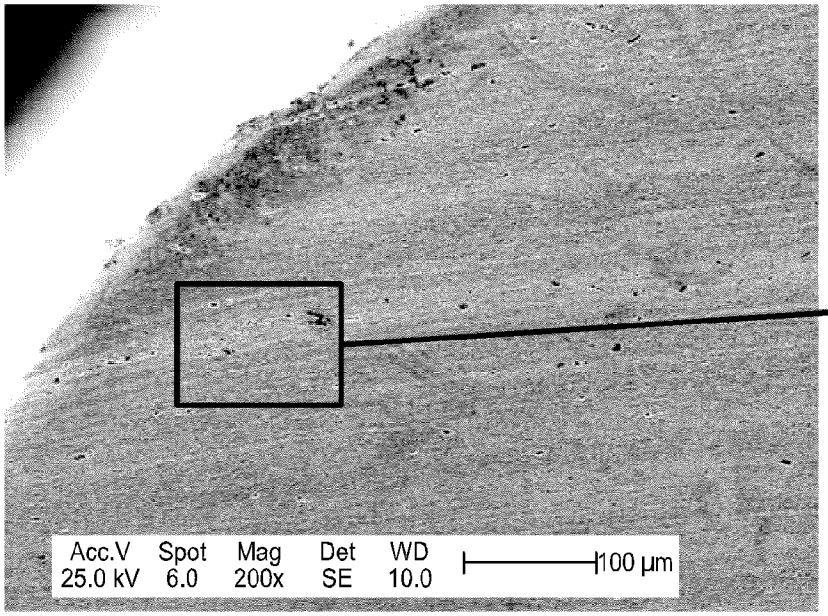
Figure 7B:
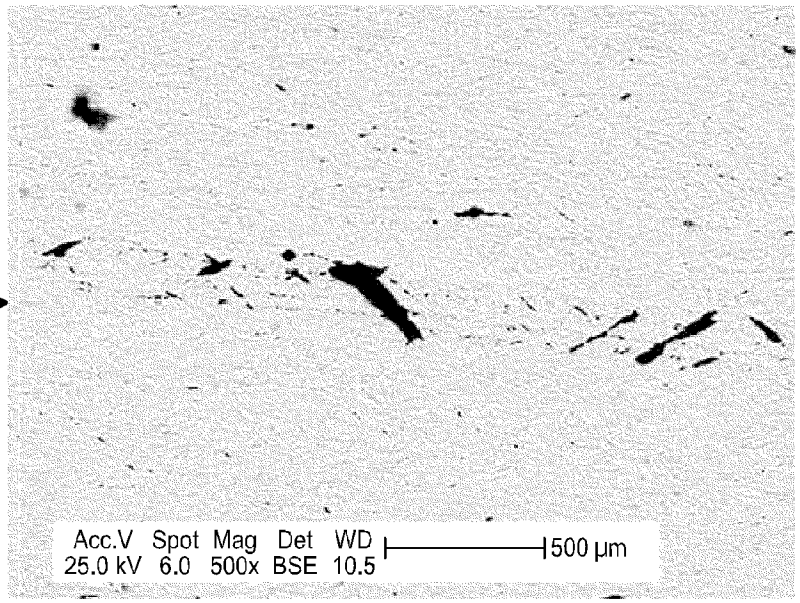
FIGS. 7A-B illustrate localized damage at the central segregation band produced during fatigue testing with high inner pressure (9500 psi) of a Grade 100 coiled tubing.
Figure 7A:
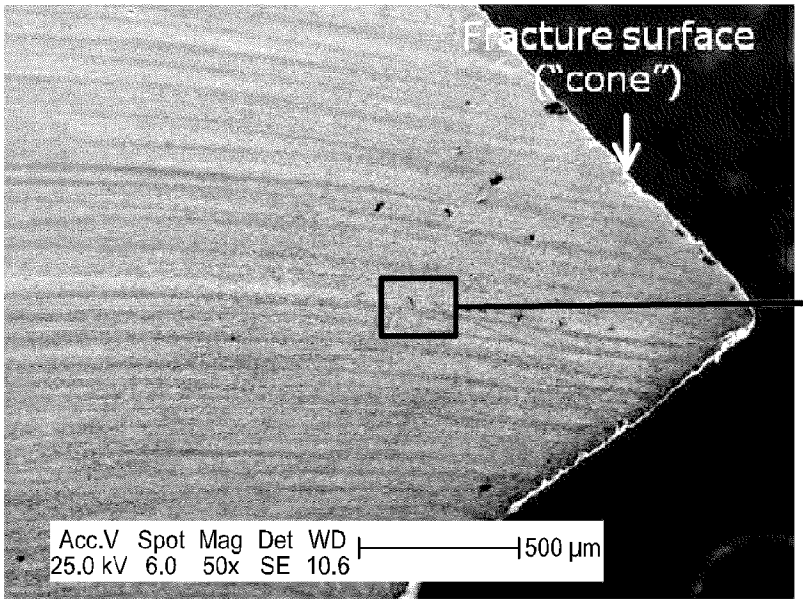

After FBHT the remnant of the central segregation band is a region enriched in substitutional solutes (as Mn, Si, Mo) with a higher density of coarse carbides than the rest of the material. This region is susceptible to nucleate cracks during low cycle fatigue, as it is observed in FIGS. 6-7. Additionally, prominent segregation bands are associated to poor SSC resistance.

Although it is not possible to remove macrosegregation, its negative effects on toughness, fatigue life and SSC resistance can be reduced by a proper selection of steel chemistry.

Based on EDX measurements on samples corresponding to a wide range of steel chemistries, enrichment factors at the central segregation band were estimated for different alloying elements. The results are shown in Table C1. The enrichment factors (EF) are the ratios between each element concentration at the central band and that corresponding to the average in the matrix. These factors are mainly dependent on thermodynamic partition coefficient between liquid and solid; and diffusivities during solidification.

TABLE C1

Enrichment factors (EF) at the central segregation band corresponding to different substitutional alloying elements.

| Element | EF |
|---|---|
| Mn | 1.6 |
| Si | 3.2 |
| Cr | 1.2 |
| Mo | 2.1 |
| Ni | 1.3 |
| Cu | 3.4 |

Table C1 shows clearly that there are some elements that have a strong tendency to segregate during solidification, like Si and Cu. On the other hand Cr and Ni have low enrichment factors. Ni is a costly addition, but Cr may be used when an increase in hardenability and/or tempering resistance is desired without producing strong segregation patterns.

The enrichment factors give information about the increase in concentration that can be expected for each element at the central segregation band. However, not all these elements have the same effect regarding the material tendency to form brittle constituents during welding or heat treatment. It is observed that the higher the improvement on hardenability, the higher the tendency to form brittle constituents during processing. It is important to mention that elements with high diffusion coefficients as Carbon and Boron may segregate during solidification, but are homogenized during hot rolling. Thereafter, they do not contribute to form brittle constituents localized at the segregation band.

From the analysis of the CCT diagrams (Example A) it can be concluded that Manganese produces the strongest increase in hardenability. This is apart from Carbon and Boron, which do not present large segregation patterns after hot rolling. On the other hand, Si and Cu, which have a strong tendency to segregate, do not play a major role on hardenability. Because of its high enrichment factor and large effect on hardenability, Mn addition has to be reduced as much as possible when trying to diminish the negative effects of macro-segregation, as the reduction in low-cycle fatigue life.

High Mn contents are ordinarily added to the steel composition because of its effect on hardenability. In this disclosure the hardenability is mostly achieved through the higher Carbon addition, so Mn concentration can be generally reduced. Further Manganese reductions can be achieved using Boron and/or Chromium additions. Examples can be seen in Table C2, which shows the critical cooling rate (CR90) for different steels composition obtained from CCT diagrams (data taken from a previous Example A). In order to achieve the hardenability in a steel with about 0.25% Carbon, Mn can be reduced from 1.6% to 1.3% when adding Boron, and further reduced to 0.4% if Cr—Mo is additionally used.

TABLE C2

Critical cooling rates to have more than 90% martensite (CR90) measured for the analyzed steels. Values determined from Gleeble ® dilatometric tests and metallographic analysis.

| Steel | C (wt %) | Mn (wt %) | Si (wt %) | Cr (wt %) | Mo (wt %) | Other | CR90 (° C./s) |
|---|---|---|---|---|---|---|---|
| CMn1 | 0.17 | 2.00 | 0.20 | — | — | — | 30 |
| CMn2 | 0.25 | 1.60 | 0.20 | — | — | — | 30 |
| BTi1 | 0.17 | 1.60 | 0.20 | — | — | B Ti | 30 |
| BTi2 | 0.25 | 1.30 | 0.20 | — | — | B Ti | 25 |
| CrMo1 | 0.17 | 1.00 | 0.25 | 1.00 | 0.50 | — | 25 |
| CrMo2 | 0.25 | 0.60 | 0.20 | 1.00 | 0.50 | — | 23 |
| CrMoBTi1 | 0.17 | 0.60 | 0.20 | 1.00 | 0.50 | B Ti | 25 |
| CrMoBTi2 | 0.24 | 0.40 | 0.15 | 1.00 | 0.25 | B Ti | 25 |
| CrMoBTi3 | 0.24 | 0.40 | 0.15 | 1.00 | 0.50 | B Ti | 15 |
| CrMoBTi4 | 0.26 | 0.60 | 0.16 | 0.50 | 0.25 | B Ti | 30 |

Example D: Homogenization of Microstructure

As was previously mentioned the fatigue life of coiled tubing is strongly dependent on microscopical features as microstructural heterogeneities. The combination of soft and hard micro-constituents tends to produce plastic strain localization, which is the driving force for crack nucleation and propagation. In this section are compared the coiled tubing microstructures obtained with the standard production method applied to chemistries within API 5ST, and those corresponding to a chemistry and processing conditions within the ranges disclosed in this disclosure.

As reference material was used a standard coiled tubing grade 110 (yield strength from 110 Ksi to 120 Ksi) with chemistry named STD2 in Table A1, which is within API 5ST specification. This standard material was compared to a coiled tubed of the same grade produced with chemistry $BTi_2$ and applying the FBHT.

In this comparison different pipe locations will be considered:

Base Metal (BM): coiled tubing microstructure apart from the ERW line and bias welds, when "apart" means that are not included in this region the Heat Affected Zones (HAZ) produced during the any welding operation and their possible Post-Weld Heat Treatment (PWHT).

Bias Weld (BW): microstructural region corresponding to the strip-to-strip joint that can be performed by Plasma Arc Welding (PAW), Friction Stir Welding (FSW) or any other welding techniques. It is also included in this region the corresponding heat affected zone during welding and PWHT.

ERW line: microstructure resulting from the longitudinal ERW welding during tube forming and its localized PWHT, which is generally a seam annealing. As in previous cases, this region also includes the corresponding heat affected zone.

Figure 8A:
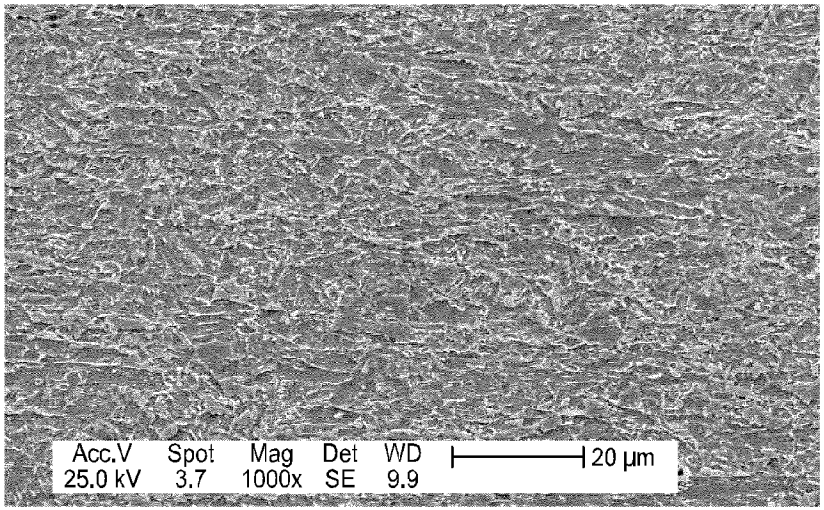
FIGS. 8A-B illustrate base metal microstructures corresponding to the standard coiled tube (A) and a coiled tube manufactured from embodiments of the present disclosure (B). In both cases the coiled tubing has tensile properties corresponding to a Grade 110 (yield strength from 110 Ksi to 120 Ksi).
Figure 8B:
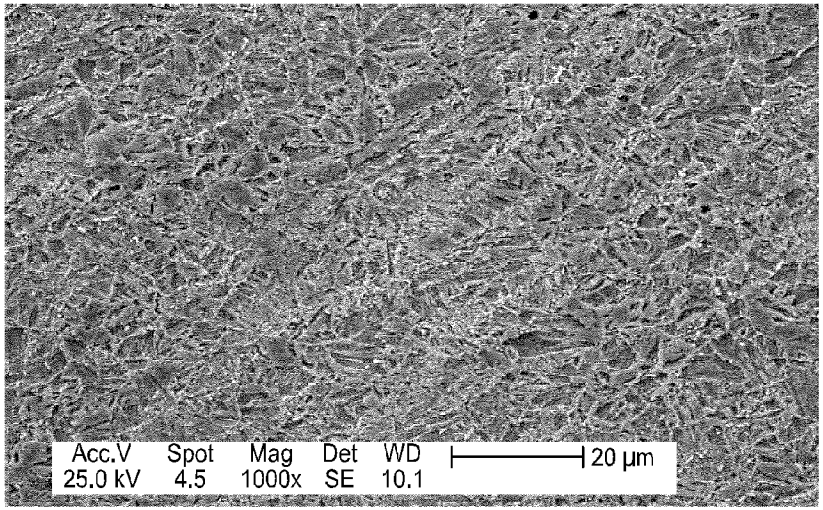

In FIGS. 8A-B are presented the base metal microstructures corresponding to the standard coiled tube (A) and this disclosure (B). In the first case it is observed a ferrite matrix with a fine distribution of carbides. This matrix and fine structure results from the controlled hot rolling process. This disclosure microstructure (FIG. 8B) is mainly composed of tempered martensite. The bainite volume fraction is lower than 5% in this case. The tempered martensite structure is also a fine distribution of iron carbides in a ferrite matrix. The main difference between conventional and new structures is related to the morphology of the ferrite grains and sub-grains, and the dislocation density. However, regarding refinement and homogeneity, both structures are very similar.

Figure 9B:
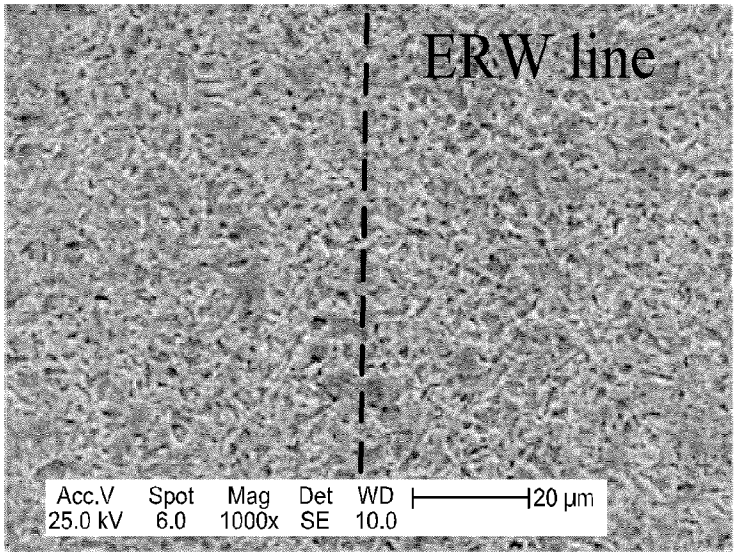
FIGS. 9A-B illustrate ERW line microstructures corresponding to the standard coiled tube (A) and a coiled tube manufactured from embodiments of the present disclosure (B). In both cases the coiled tubing tensile properties correspond to a Grade 110 (yield strength from 110 Ksi to 120 Ksi).
Figure 9A:
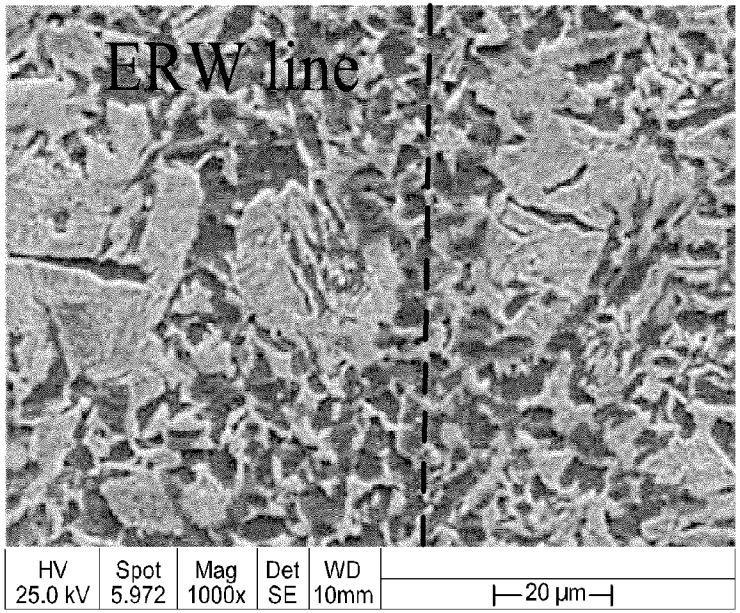

In FIGS. 9A-B are shown scanning electron micrographs corresponding to the ERW line. It is clear that in the conventional structure two micro-constituents appear: there are soft ferrite grains and hard blocks composed of a mixture of fine pearlite, martensite and some retained austenite. In this type of structure plastic strain is localized in the ferrite, and cracks can nucleate and propagate in the neighboring brittle constituents (non-tempered martensite and high carbon retained austenite). On the other hand, the ERW line microstructure obtained with chemistry and processing conditions within the ranges of this disclosure is homogeneous and very similar to the corresponding base metal structure.

Figure 10A:
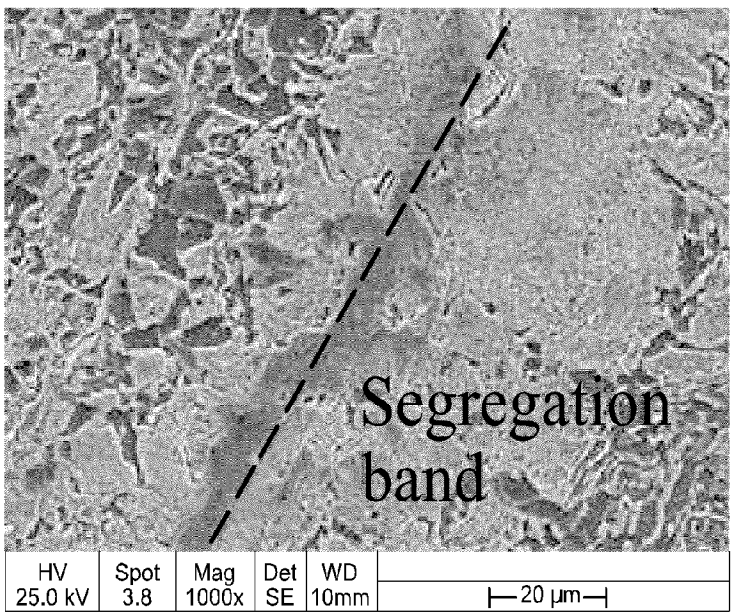
FIGS. 10A-B illustrate microstructures corresponding to HAZ of the ERW for the standard coiled tube (A) and a coiled tube manufactured from embodiments of the present disclosure (B). In both cases the coiled tubing tensile properties correspond to a Grade 110 (yield strength from 110 Ksi to 120 Ksi).
Figure 10B:
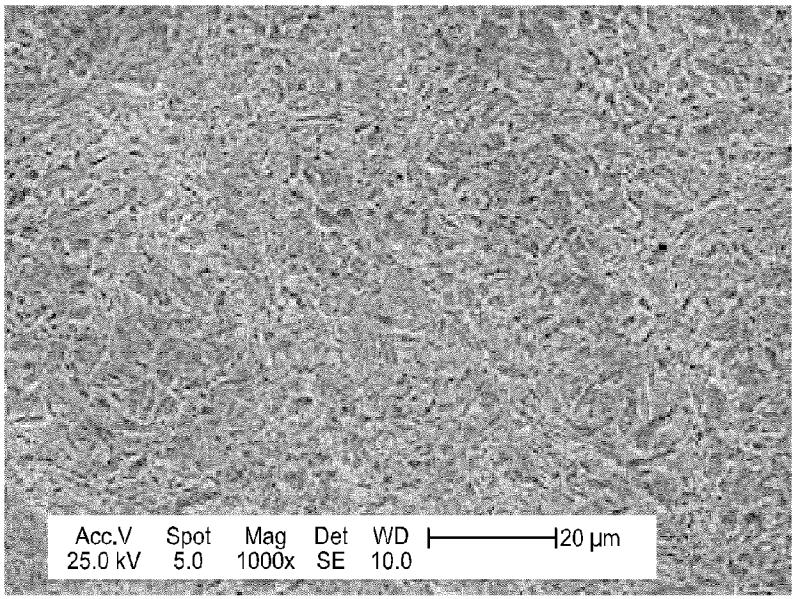

Microstructures corresponding to the HAZ of the ERW are presented in FIGS. 10A-B. In the standard material it is clear the appearance of the remnant of the central segregation band, which after seam annealing is partially transformed into non-tempered martensite. Again, these are brittle constituents that are localized along the ERW line, and can nucleate and propagate cracks during service. The risk of failure is higher than in previous case because of the larger size of the just mentioned constituents. On the other hand, in the quenched and tempered coiled tubing the structure close to the ERW line is homogeneous, and the remnants of the central segregation band are not observed.

Figure 12:
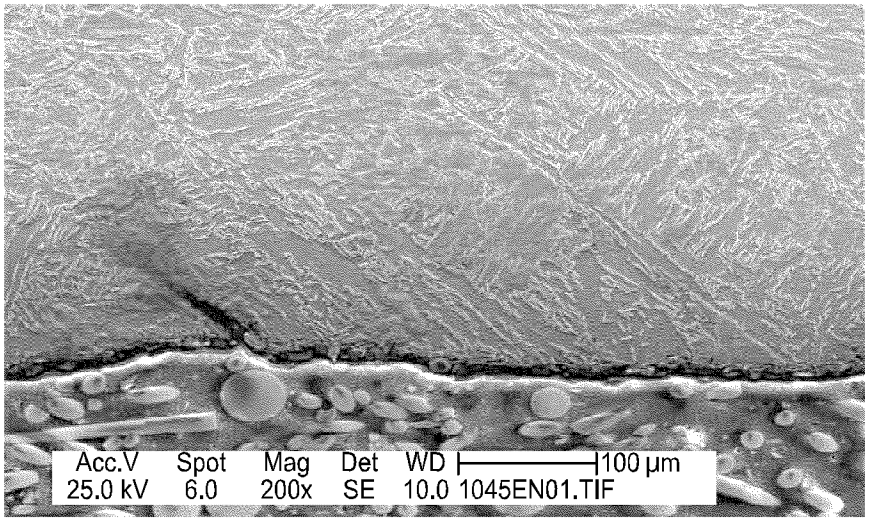
FIG. 12 illustrates a crack formed during service in the fusion zone of a bias weld (growing from the internal tube face). The crack is running in the direction of the large upper bainite laths.

In FIGS. 11A-B are presented some scanning electron micrographs corresponding to the bias-weld HAZ of both conventional coiled tube and this disclosure. For the conventional material the microstructure is very different than in Base Metal (BM). It is mainly composed of upper bainite and the grain size is large (50 microns in comparison of less than 15 microns for the BM). This type of coarse structure is not adequate for low cycle fatigue because cracks can easily propagate along bainitic laths. An example of a fatigue crack running across coarse bainite in the bias weld is shown in FIG. 12. This is a secondary crack located close to the main failure occurred during service of a standard coiled tubing grade 110.

On the other hand, the bias weld microstructure in this disclosure is again very similar to that corresponding to the base metal. No upper bainite grains were observed. It is important to mention that some bainite may appear after the full body heat treatment, but because of the selection of adequate chemistry and processing conditions, the corresponding volume fraction of this constituent is lower than 10%. This is the main reason for the good hardenability to the chemistries described in this disclosure. Additionally, due to the upper limit in the austenitization temperature the final grain size is small (lower than 20 microns), then large bainitic laths that can propagate cracks are completely avoided.

Figure 13:
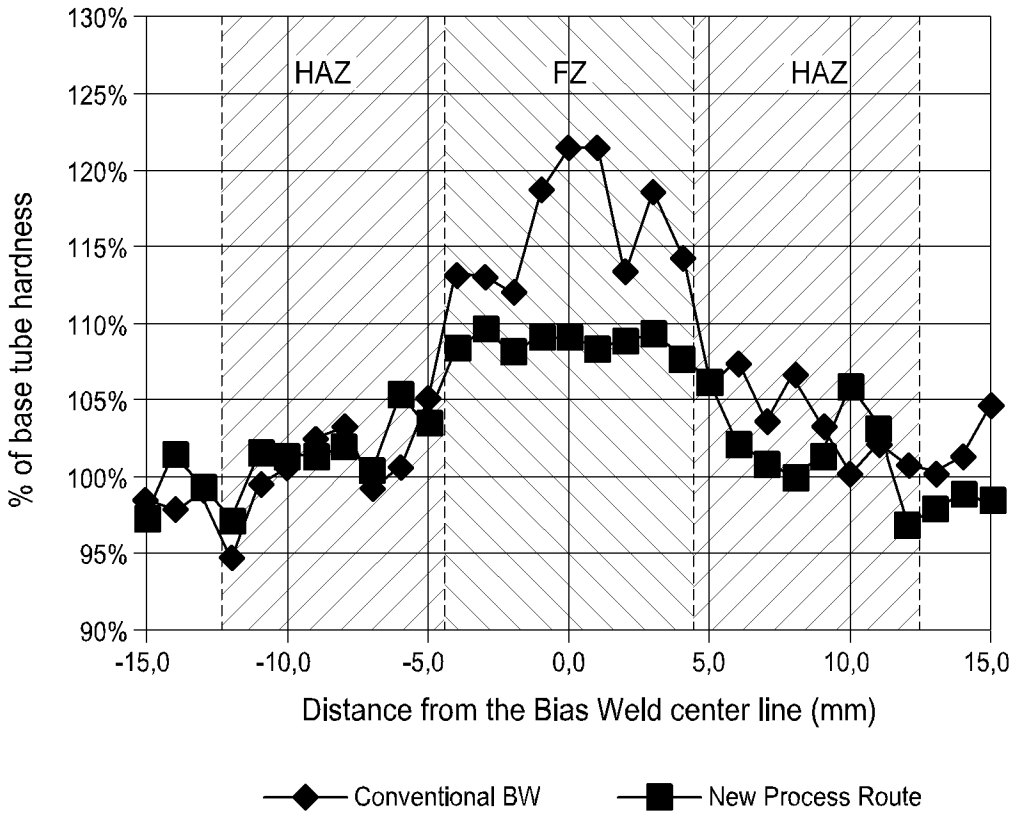
FIG. 13 illustrates variations in hardness (base metal hardness=100%) across typical bias welds obtained with conventional processing and processing according to embodiments of the present disclose. The fusion zone (FZ) is approximately located in the area between≈+/−5 mm from the weld center.

Other examples of the microstructural homogeneity achievable by the combination of steel chemistry and processing conditions disclosed in this disclosure are presented in FIGS. 13-14. In FIG. 13 is shown the typical variation in hardness across the bias weld for coiled tubes produced conventionally compared to that obtained using the new chemistry and processing route. It is clear that when using this disclosure the hardness variation is strongly reduced. As a consequence, the tendency of the material to accumulate strain in localized regions (in this case the HAZ of the bias weld) is also reduced, and the fatigue life improved.

Figure 14B:
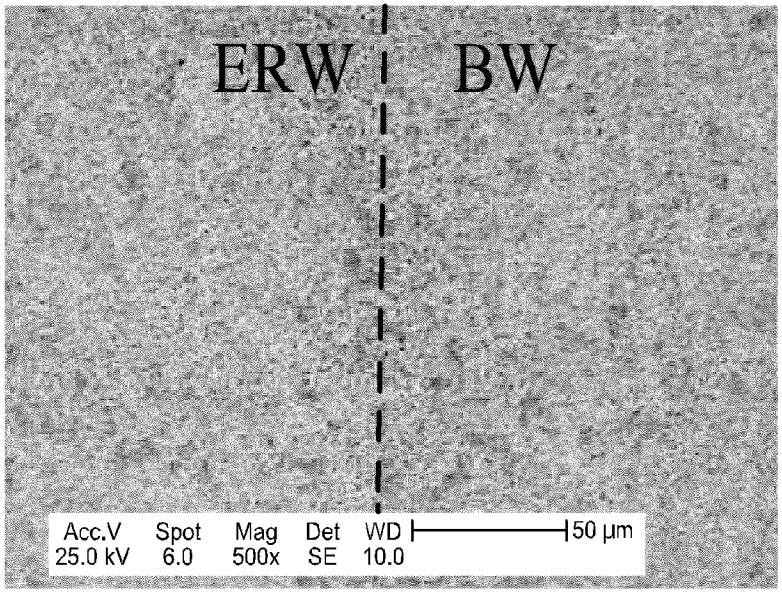
FIGS. 14A-B illustrate microstructures corresponding to the intersection between bias weld and ERW line for the standard coiled tube (A) and a coiled tube manufactured from embodiments of the present disclosure (B). In both cases the coiled tubing tensile properties correspond to a Grade 110 (yield strength from 110 Ksi to 120 Ksi).
Figure 14A:
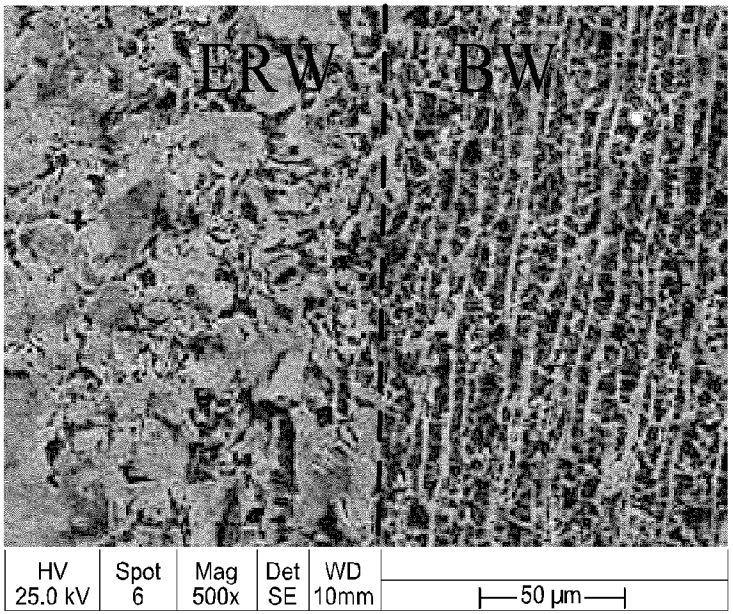

In FIGS. 14A-B are shown some microstructures corresponding to the intersection between the bias weld and the ERW line. It is clear that large microstructural heterogeneities are obtained following the conventional route. These heterogeneities are successfully eliminated using the chemistry and processing conditions disclosed in this disclosure.

Example E: Coiled Tube Fatigue Testing

Figure 15:
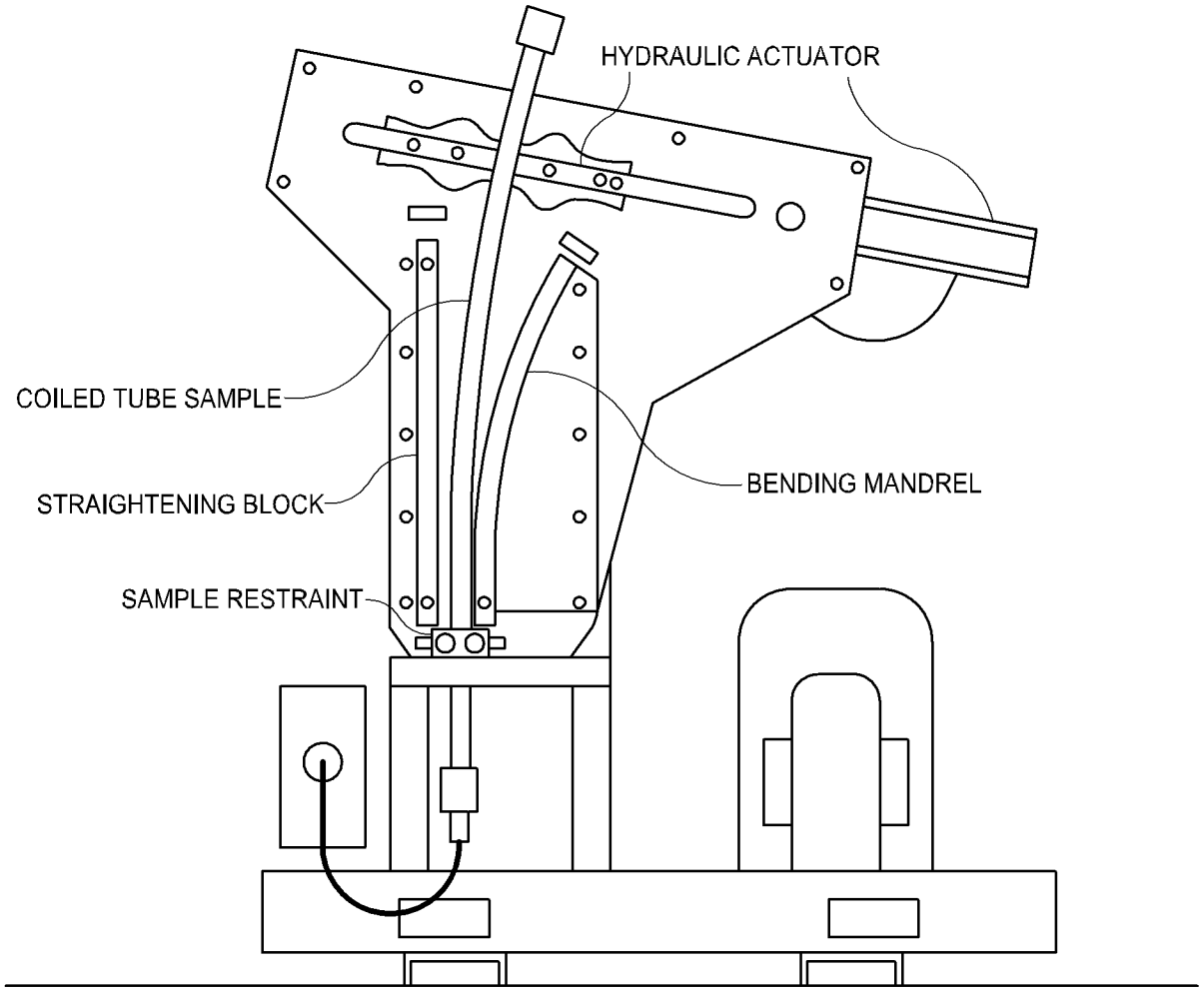
FIG. 15 illustrates a schematic drawing of a fatigue testing machine.

In order to compare the performance of coiled tubing produced according to this disclosure with that corresponding to standard products, a series of tests were performed at laboratory. Coiled tube samples were tested in a fatigue machine schematically shown in FIG. 15. This machine is able to simulate the bending deformations during spooling and un-spooling operations, applying at the same time internal pressures. Therefore, the tests are useful to rank materials under low-cycle fatigue conditions that are close to those experienced during actual field operation.

During testing, the fatigue specimens (tube pieces 5 or 6 feet long) are clamped on one end while an alternative force is applied by a hydraulic actuator on the opposite end. Deformation cycles are applied on the test specimens by bending samples over a curved mandrel of fixed radius, and then straightening them against a straight backup. Steel caps are welded at the ends of the specimen and connected to a hydraulic pump, so that cycling is conducted with the specimen filled with water at a constant internal pressure until it fails. The test ends when a loss of internal pressure occurs, due to the development of a crack through the wall thickness.

Testing was performed on coiled tubing with different chemistries and grades, as shown in Table E1. The pipe geometry was the same in all cases (OD 2", WT 0.19"). STD1, STD2 and STD3 are steels within the limits described in API 5ST, processed following the standard route. $BTi_1$, $BTi_2$ and $CrMoBTi_4$ are chemistries selected and processed according to this disclosure. It is important to mention that $CrMoBTi_4$ steel was used to produce two non-standard grades with 125 Ksi and 140 Ksi of minimum yield strength (the highest grade described in API 5ST has 110 Ksi of SMYS). Tests were performed on tube pieces with and without the bias weld (in all cases the longitudinal ERW line is included in the samples). The severity of the test mainly depends on two parameters: bend radius and inner pressure. In this study the bend radius was 48 inches, which corresponds to a plastic strain of about 2%. Inner pressures between 1600 psi and 13500 psi were considered, producing hoop stresses that ranged from about 10% to 60% of the minimum yield strength of the grades.

TABLE E1

Steel chemistries and coiled tube grades analyzed in this study.

| Steel | C (wt %) | Mn (wt %) | Si (wt %) | Cr (wt %) | Mo (wt %) | Other | Grade |
|---|---|---|---|---|---|---|---|
| STD1 | 0.13 | 0.80 | 0.35 | 0.52 | — | Ni, Cu, Ti | 80 |
| STD2 | 0.14 | 0.80 | 0.33 | 0.55 | 0.10 | Ni,Cu, Nb Ti | 90 |
| STD3 | 0.14 | 0.80 | 0.34 | 0.57 | 0.32 | Ni,Cu, Nb Ti | 110 |
| BTi1 | 0.17 | 1.60 | 0.20 | — | — | B Ti | 80 |
| BTi2 | 0.25 | 1.30 | 0.20 | — | — | B Ti | 90, 110 |
| CrMoBTi4 | 0.26 | 0.60 | 0.16 | 0.50 | 0.25 | B Ti | 125, 140 |

Figure 16:
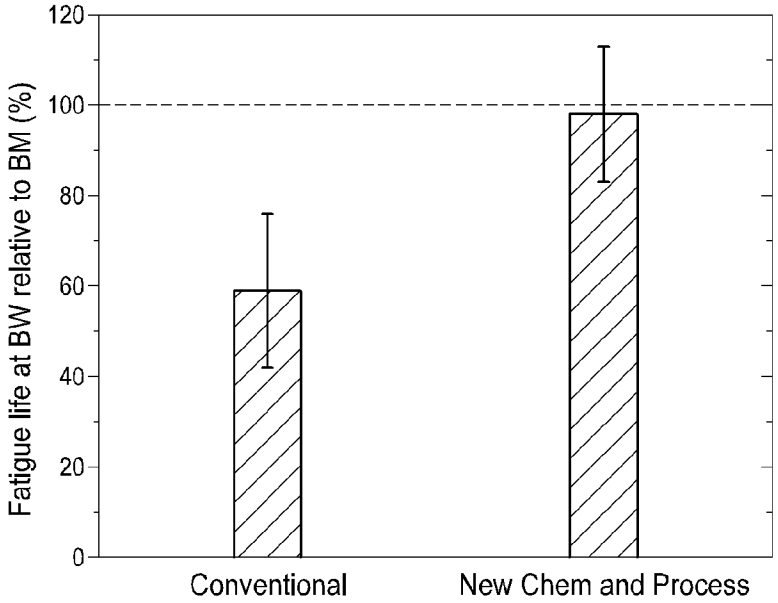
FIG. 16 illustrates fatigue life measured for BW samples relative to those corresponding to BM samples. Results are average values over different testing conditions and coiled tube grades (80, 90 and 110 for conventional tubes and 80, 90, 110, 125 and 140 for coiled tubes produced according to this disclosure).

In FIG. 16 is presented some results regarding the comparison between the fatigue life measured in samples with and without the Bias Weld (BW). The values shown in the figure correspond to the averages obtained when testing conventional and non-conventional coiled tubes grades. In the case of the conventional material there is clearly a reduction in fatigue life when testing samples containing the bias weld. On the other hand, the coiled tubes produced according to this disclosure do not present an important change in fatigue life when the tests are performed on BW samples. This is a consequence of the tube homogeneous structure, with almost no differences in mechanical properties between base metal, ERW line and bias weld.

Figure 17:
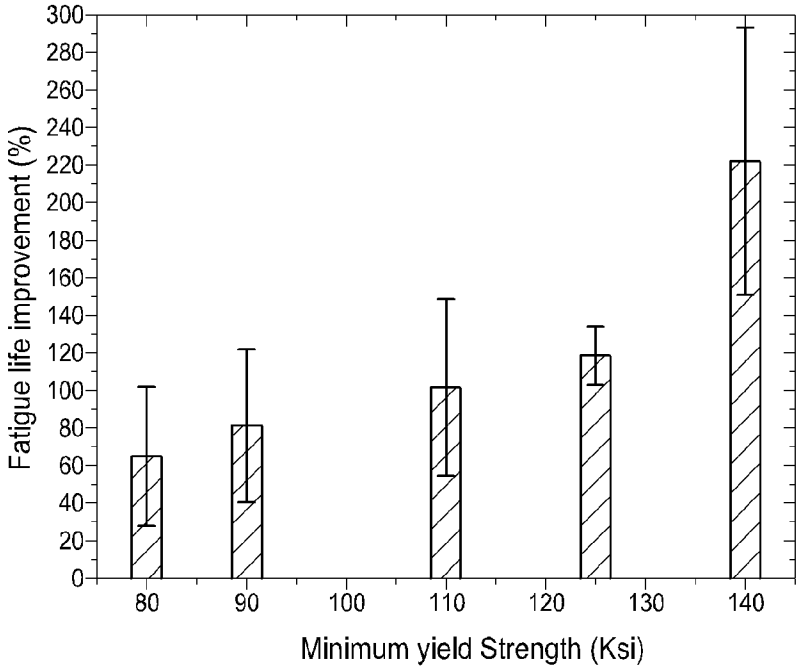
FIG. 17 illustrates fatigue life improvement in coiled tubes produced with an embodiment of the chemistry and processing conditions according to this disclosure. The improvement is determined by comparison against fatigue life measured for conventional coiled tubing of the same grade tested under similar conditions. Results are averaged for each grade over different testing conditions. In the case of grades 125 and 140, which are non-standard, the fatigue life comparison was performed against STD3 steel in Grade 110.

In FIG. 17 is shown the coiled tube fatigue life improvements obtained with chemistries and processing conditions as disclosed by this disclosure. For Grades 80, 90 and 110 the comparison was made against the equivalent grade produced by the conventional route. In the case of grades 125 and 140, which are non-standard, the fatigue life comparison was performed against STD3 steel in Grade 110 tested under the similar conditions (pipe geometry, bend radius and inner pressure). The results presented in the figure correspond to average values for each grade, the error bars represent the dispersion obtained when using different inner pressures.

In FIG. 17 it is clear that a notorious improvement of fatigue life is observed when using chemistries and processing conditions according to this disclosure. For example, in Grade 110 there was an improvement of about 100% in fatigue life. This is a consequence of the fact that in conventional coiled tubing the fatigue performance is limited to that of the bias weld (which is generally the weak point regarding low cycle fatigue, because its microstructural heterogeneities and brittle constituents). In coiled tubes produced according to this disclosure there is no important fatigue life reduction at bias welds, which strongly increases the overall performance of the tube. Regarding the non-standard grades, the large improvement in fatigue life is due to the fact that the comparison is made against a conventional 110 grade tested under similar processing conditions. However, for the same inner pressures the applied hoop stresses are closer to the minimum yield strength of the lower grade, and the test severity increases for grade 110 in comparison to grades 125 and 140. These results show that by using higher grades (not achievable with the conventional method) fatigue life is strongly increased for the same service conditions.

Example F: Sulfide Stress Cracking Resistance

Material performance in regards to hydrogen embrittlement in $H_2S$ containing environments is related to the combined effects of corrosive environments, presence of traps (e.g. precipitates and dislocations) that could locally increase hydrogen concentration, as well as the presence of brittle areas, in which cracks could easily propagate. A possible source of critical brittle regions in conventional coiled tubing material is the segregation pattern of substitutional elements, such us Mn, in the raw material. Regions of differential concentrations tend to respond in a distinct way to thermal cycles imposed during bias weld, PWHT, ERW and seam annealing, and could lead to the local formation of brittle constituents. In particular, when the material is seam annealed after the ERW process, the pipe body quickly extracts heat from the weld area. If the segregation is high enough, elongated high hardness areas with the possible presence of martensite may be formed as a consequence of the cooling conditions. These areas will remain in the tube to become easy paths for crack propagation. The fact that the new process is applied as the last stage of manufacturing, allows for the minimization of the excessively hardened areas. Other relevant differences are: a) the dislocations introduced during pipe cold forming are not present in the new product, b) the carbides in new product are smaller and isolated in comparison with the typical pearlite/bainite long brittle carbides. As a consequence the coiled tube produced with chemistries and processing conditions according to this disclosure presents an improved performance to cracking in $H_2S$ containing environments.

TABLE F1

Steel chemistries and coiled tube grades analyzed in this study.

| Steel | C (wt %) | Mn (wt %) | Si (wt %) | Cr (wt %) | Mo (wt %) | Other | Grade |
|---|---|---|---|---|---|---|---|
| STD1 | 0.13 | 0.80 | 0.35 | 0.52 | — | Ni, Cu, Ti | 80 |
| BTi1 | 0.17 | 1.60 | 0.20 | — | — | B Ti | 80 |

In order to perform a first analysis on resistance to SSC cracking, coiled tube Grade 80 samples produced by i) the standard process and ii) the new chemistry-process were evaluated using method C (C-ring) of NACE TM0177. Steel chemistries are shown in Table F1. Both materials (3 specimens in each case) were tested with the ERW seam at center of C-ring sample, using the following conditions:

Load: 90% of 80 Ksi, Solution A, 1 bar $H_2S$, Test Time: 720 hs

In the case of the standard coiled tube all 3 specimens failed. On the other hand, the 3 samples corresponding to the new chemistry-process passed the test (FIGS. 5A-B with pictures of C-rings). Although more tests are ongoing to analyze embrittlement resistance of different grades, as well as the effect of the bias weld, this first result shows a clear improvement in comparison with the standard condition, ascribed to a more homogeneous microstructure of base metal and ERW line in the case of the new process route.

Figure 18B:
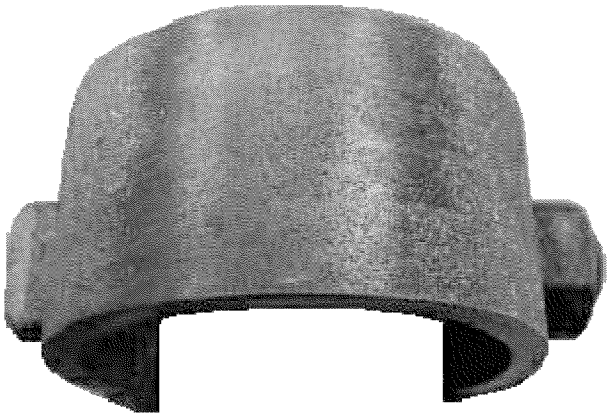
FIGS. 18A-B illustrate C-ring samples after testing material grade 80 according to NACE TM0177 (90% SMYS, Solution A, 1 bar $H_2S$). A: conventional process. B: embodiment of the disclosed process.
Figure 18A:
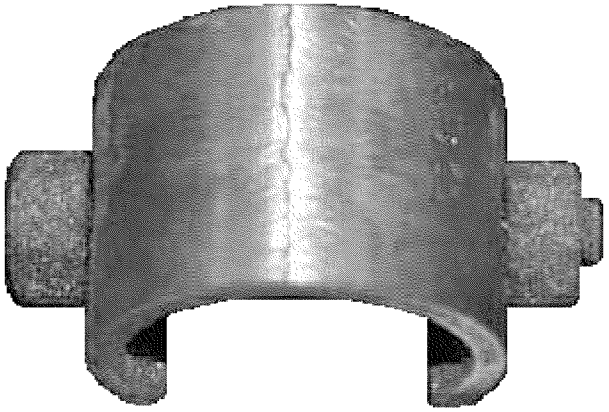

As shown in FIGS. 18A-B, the C ring formed by the conventional process has a large crack down the middle, whereas the C ring formed by embodiments of the disclosed process did not crack.

In some embodiments, B—Ti and Cr—Mo additions can reduce maximum Mn. In some embodiments, grades may be higher than 110 that are difficult to achieve using the standard method.

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and apparatuses described herein may be embodied in a variety of other forms. Furthermore, various omissions, substitutions and changes in the form of the methods, compositions and apparatuses described herein may be made. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future.

What is claimed is:

1. A coiled steel tube having improved yield strength and fatigue life at weld joints of the coiled tube, the coiled steel tube comprising:

a plurality of strips welded together end to end by a bias weld and formed into a coiled steel tube, each of the plurality of strips having base metal regions, bias weld joints, and heat affected zones surrounding the bias weld joints, each of the plurality of welded strips comprising:

a yield strength greater than about 80 ksi;

a composition comprising iron and:

0.17-0.35 wt. % carbon;

0.30-2.00 wt. % manganese;

0.10-0.30 wt. % silicon;

0.010-0.040 wt. % aluminum;

up to 0.010 wt. % sulfur; and up to 0.015 wt. % phosphorus; and wherein the coiled steel tube has a final microstructure formed from a full body heat treatment applied to the coiled steel tube;

wherein the final microstructure comprises a mixture of tempered martensite and bainite;

wherein the final microstructure of the coiled steel tube comprises more than 90 volume % tempered martensite in the base metal regions, the bias weld joints, and the heat affected zones;

wherein the final microstructure across all base metal regions, bias weld joints, and heat affected zones is homogeneous; and wherein the final microstructure comprises a uniform distribution of fine carbides across the base metal regions, the bias weld joints, and the heat affected zones.

2. The coiled steel tube of claim 1, wherein the composition further comprises:

up to 1.0 wt. % chromium;

up to 0.5 wt. % molybdenum;

up to 0.0030 wt. % boron;

up to 0.030 wt. % titanium;

up to 0.50 wt. % copper;

up to 0.50 wt. % nickel;

up to 0.1 wt. % niobium;

up to 0.15 wt. % vanadium;

up to 0.0050 wt. % oxygen; and up to 0.05 wt. % calcium.

3. The coiled steel tube of claim 2, wherein the composition comprises:

0.17 to 0.30 wt. % carbon;

0.30 to 1.60 wt. % manganese;

0.10 to 0.20 wt. % silicon;

up to 0.7 wt. % chromium;

up to 0.5 wt. % molybdenum;

0.0005 to 0.0025 wt. % boron;

0.010 to 0.025 wt. % titanium;

0.25 to 0.35 wt. % copper;

0.20 to 0.35 wt. % nickel;

up to 0.04 wt. % niobium;

up to 0.10 wt. % vanadium;

up to 0.0015 wt. % oxygen;

up to 0.03 wt. % calcium;

up to 0.003 wt. % sulfur; and up to 0.010 wt. % phosphorus.

4. The coiled steel tube of claim 1, wherein the tube has a minimum yield strength of 125 ksi.

5. The coiled steel tube of claim 1, wherein the tube has a minimum yield strength of 140 ksi.

6. The coiled steel tube of claim 1, wherein the tube has a minimum yield strength of between 125 ksi and 140 ksi.

7. The coiled steel tube of claim 1, wherein the final microstructure comprises at least 95 volume % tempered martensite in the base metal regions, the bias weld joints, and the heat affected zones.

8. The coiled steel tube of claim 1, wherein the tube has a final grain size of below 20 μm in the base metal regions, the bias weld joints, and the heat affected zones.

9. The coiled steel tube of claim 8, wherein the tube has a final grain size of below 15 μm in the base metal regions, the bias weld joints, and the heat affected zones.

10. The coiled steel tube of claim 1, wherein the fatigue life at the bias welds is at least about 80% of the base metal regions.

11. The coiled steel tube of claim 1, wherein a percent hardness of a bias weld joint, including its heat affected zone, is 110% or less than a hardness of the base metal.

12. The coiled steel tube of claim 1, wherein the coiled steel tube passes method C of NACE TM0177 for resistance to SSC cracking.

13. The coiled steel tube of claim 1, wherein a final length of the coiled steel tube is between 10,000 feet and 40,000 feet.

14. The coiled steel tube of claim 1, a fatigue life that is at least 100% greater than an equivalent grade steel which has not undergone the fully body heat treatment.

15. The coiled steel tube of claim 1, wherein the coiled steel tube has a reduced segregation band as compared to the equivalent grade steel which has not undergone the full body heat treatment.

* * * * *